US007210605B2

(12) United States Patent
Willows et al.

(10) Patent No.: US 7,210,605 B2
(45) Date of Patent: May 1, 2007

(54) HARNESS

(76) Inventors: Keith S. Willows, 1823 12th Ave. W., Seattle, WA (US) 98119; June A. Angus, 1823 12th Ave. W., Seattle, WA (US) 98119; Antonio Del Rosario, 31525 10th Ave. S., Federal Way, WA (US) 98003

( * ) Notice: Subject to any disclaimer, the term of this patent is extended or adjusted under 35 U.S.C. 154(b) by 81 days.

(21) Appl. No.: 10/929,668

(22) Filed: Aug. 29, 2004

(65) Prior Publication Data

US 2005/0045687 A1 Mar. 3, 2005

Related U.S. Application Data

(60) Provisional application No. 60/498,964, filed on Aug. 30, 2003.

(51) Int. Cl.
*A45F 3/04* (2006.01)
*A45F 3/00* (2006.01)

(52) U.S. Cl. ..... 224/637; 224/623

(58) Field of Classification Search ..... 224/637
See application file for complete search history.

(56) References Cited

U.S. PATENT DOCUMENTS

| | | | | | |
|---|---|---|---|---|---|
| 1,310,958 | A | * | 7/1919 | O'Connor | 297/484 |
| 4,479,267 | A | | 10/1984 | Radowsky, Jr. | |
| 4,534,619 | A | | 8/1985 | Bedford | |
| 4,764,962 | A | * | 8/1988 | Ekman et al. | 381/301 |
| D342,348 | S | * | 12/1993 | Panarelli | D29/101.1 |
| 5,333,768 | A | | 8/1994 | Krentz | |
| D351,051 | S | | 10/1994 | Pearson et al. | |
| 5,477,998 | A | | 12/1995 | Reckler | |
| 5,575,004 | A | | 11/1996 | Eisele et al. | |
| 5,624,065 | A | | 4/1997 | Steffe | |
| 5,787,500 | A | | 8/1998 | Lobello | |
| 5,915,609 | A | | 6/1999 | Diakoulas | |
| D422,931 | S | | 4/2000 | Agnew | |
| D435,168 | S | * | 12/2000 | Momburg | D3/215 |
| 2003/0178461 | A1 | * | 9/2003 | Shattuck | 224/614 |

OTHER PUBLICATIONS

JOGALITE, Safety Center Catalog, no date.

* cited by examiner

*Primary Examiner*—Nathan J. Newhouse
*Assistant Examiner*—Lester L. Vanterpool
(74) *Attorney, Agent, or Firm*—Black Lowe & Graham PLLC

(57) ABSTRACT

An improved harness or harness-like garment for purposes of making the user more visible and/or with optional pocket or item(s) carrying means, having strap or straps or strap-like element(s) configured in two substantially "Y" or "V" shaped forms or one of each; the tops of the substantially "Y"-shaped and/or "V"-shaped forms are joined together, fused or one part; the bottoms of the substantially "Y" and/or "V"-shaped forms are fastened, joined fused or in one part to a waist strap forming means so that they meet the waist strap forming means at substantially 180 degrees from each other around the somewhat circular waist strap forming means; the waist strap forming means preferably having closure means.

20 Claims, 22 Drawing Sheets

HARNESS

CROSS REFERENCE—RELATED PROVISIONAL PATENT APPLICATIONS

This application references and claims priority of Provisional Patent Application, No. 60/498,964, filed on Aug. 30, 2003, Titled: "Harness"—Applicants Keith S. Willows, June A. Angus of Seattle, Wash. and Antonio Del Rosario of Bellevue, Wash.

I. BACKGROUND—FIELD OF THE INVENTION

The present invention relates to reflective and/or high visibility garments, and more particularly to a harness system used to make the user more visible during daylight, night-time and twilight hours having the abilities to provide very simple use and comfort. For a jogger or other user it increases the ability to indicate a presence which might not otherwise be clearly and easily apparent. The invention also optionally provides a pocket which can be conveniently located for access for use of the person engaging in vigorous activity. It also allows these items to be carried comfortably, easily assessable, and without interfering with the warning capabilities of the harness. The harness of the present invention furthermore provides simple height and a waist adjustment. The device of the present invention is designed primarily for active sports joggers and bicyclists. It is also suitable for pedestrians, crossing guards, traffic policemen, mail personnel, roller bladers, skate boarders, delivery personnel, for walking the dog or children playing in or around roadways.

II. BACKGROUND—DESCRIPTION OF PRIOR ART

Reflective warning devices have been used for some time.

U.S. Pat. No. 5,624,065—Steffe discloses a safety sport belt having a waist belt and at least one shoulder strap slidingly connected to the waist belt. The waist belt and the strap comprised of a polyester mesh fabric coated with reflective material. A transparent strip is centrally aligned on outer surface of the shoulder strap and the waist belt, which is stitched over a non-transparent strip of a polyester reflective material. The waist belt has a holder for radio and another holder for liquid container and the shoulder strap has a container for holding lock key and a second container for holding a defensive spray applicator U.S. Pat. No. 3,089,143—JACOBSON discloses a traffic safety belt with criss-cross shoulder straps each of which is adjustable, together with an adjustable waistband portion so that one adjustment does not interfere with the other.

U.S. Pat. No 3,221,958—STRAIGHT discloses a safety belt designed for hunters and features shoulder straps that are adjustable without interfering with the adjustment of the belt which is accomplished by providing separate attaching loops and adjusting loops at the base of each shoulder strap. The shoulder straps may be pivoted about a grommet in order that a gun sling secured to the base of one shoulder strap may be easily switched from one shoulder to the other to accommodate both left and right-handed people. The structure comprises a woven mesh underlying belt which is provided with a fused reflective film on the top of it. The underlying web backing is preferably white to enhance the visibility of the transparent, brightly-colored reflective material which is fused over it.

U.S. Pat. No. 3,499,416—THORSHEIM also discloses a reflective safety band in the upper rows of the simple structure and features, but includes construction to provide a means of storing the device within banded loops as well as a means to adjust the length of the strap by overlapping it on itself within the securing means.

U.S. Pat. No. 5,410,762—MASKOVICH discloses an elastic strap for a jogger's compact portable device for carrying a portable radio that can be manipulated without interfering with the jogger's activity and secured against both vertical and horizontal movement from the jogger's activity. The device includes a stretchable strap having slots at each end which are less than the width of the device to be carried and results in the portable device or radio being frictionally compressed between the wearer's belt and the strap attachment. The portable device usually has a hook to fit over the belt to supply additional security. The strap ideally is made of neoprene.

One of the inherent disadvantages of prior art safety belts or warning belts and/or straps has been that for utilization that by people in jogging or engaging in other athletic activities which require a great deal of exertion is that the devices have been generally made in a manner that is uncomfortable to the wearer, they are confining, they tangle easily, and generally are not intuitively useable.

In addition, those devices which provided carrying means for certain ancillary items such as radio, personal items, and the like were awkward to use, involved heavy enclosure-means and were less accessible to the user while the user was engaged in the athletic activity as well as configured in such a way that bounced while in use. Adjustment means were also difficult to operate and in those cases where they were easy, the fastening means tended to become undone easily and not intuitively useable.

In addition the above inventions and/or their features, heretofore known suffer from drawbacks and disadvantages in combinations in the following areas:

Causes user discomfort through bouncing and chafing
Lack optimal ergonomics and contouring relative to the human body
Incorporate complex use requirements or components
Difficulty in accessing pocket
Unreliable retainment or items carried
Employ features which present obstacles to optimal athletic or general performance limited versatility for range of uses and range of users
Difficult to use and/or inconvenient to use
Poorly integrated features
Asymmetrically weighted when in use which puts undue stress on the body

III. OBJECTS AND ADVANTAGES

There are many benefits of the disclosed novel "harness" over existing traditional harnesses, vests, apparel and other visibility items meant to be worn on the body. First the disclosed novel harness is easy to put on and take off and easily adjusts to fit a variety of body sizes and types (generally only one size is needed to fit most adult people). Because of the preferable adjustability and/or preferably stretchy straps or strap-like components a few sizes could fit children to adults. The herein disclosed novel "harness" does not tangle easily when putting on. Another benefit is that the disclosed geometry of the novel "harness" restricts the user's mobility to a minimum while maximizing the user's visibility and/or providing a benefit to the user with the disclosed utility—pocket(s), electronic devices, lights, etc.—integration. The positioning of the disclosed central high visibility element(s), central to the user's upper body locates this high visibility area (front and/or back) for excellent visibility yet its geometry/placement does not limit user mobility. Another benefit of the disclosed invention is the accessory/item carrying means that is also outlined and pictured. This Accessory/item carrying means allows the user to carry/hold a variety of items from keys to electronic items like strobe lights, flashers, lights or the like, radios, cell phones, food, water, etc. The geometry of the disclosed item carrying/holding means is configured in a way to minimize bouncing and jingling of the items being carried while allowing excellent accessibility to these items (while on the go). The preferably somewhat downward wedge shaped pocket/item carrying means keeps items from bouncing and jostling because of its unique downward wedge shape (gravity forces the object down into this wedge area, minimizing movement of the object held within the pocket). Also accessibility areas are also disclosed which add functionality—allow the user to route cables, access buttons, a pass-through for a drink tube, antenna, etc. Yet another important novel potential feature of the disclosed utility panel(s) or item carrying means is a window area located somewhere on this disclosed panel, the window, open completely and/or in areas and/or being covered by a material such as mesh, clear flexible vinyl, sheer fabric, etc. or the like. This disclosed window is fashioned in such a way to provide accessibility in some way to the items inside the window (being held on the user)—accessibility to buttons, displays, knobs, LCD panels, etc. or the like. Through this window the user can potentially more easily read LCD display, press a button, turn a knob or the like or a strobe light or illumination device can shine its light through this window illuminating the user's path and/or providing warning of the wearer's presence. An example of this window or window like feature is shown in FIG. 1., element 111 showing a preferable sheer fabric window area. This element 111 could obviously be made of many materials or take many shapes for example it could be clear vinyl, mesh, sheer fabric, fabric with strategically placed holes or also this element could be eliminated so that there was an open window here. There are many options for this element depending the utility of the panel/utility area. Also this window area could take the form of integrating into the panel itself without an extra part (by a simple punched hole or holes or the like)—see FIG. 8 for an example of a hole punched in this panel.

There has now been developed, and disclosed herein a new and novel device which has a number of advantages not possessed by the products of this type known to heretofore be available. These disadvantages of the prior art are overcome by the device of the present invention which provides an effective warning indication of the presence of the wearer, is easily adjustable, intuitive to use, comfortable, fits a variety of body shapes and sizes easily, is simple to manufacture, doesn't tangle easily, is aesthetically pleasing, dissipates body heat, and allows the option of carrying personal items like keys, energy gel, chapstick, eye drops and the like.

IV. SUMMARY

In accordance with the present invention a harness or harness-like garment for purposes of making the user more visible and/or with optional pocket or item(s) carrying means, embodying the principals of the invention has strap or straps or strap-like element(s) configured in two substantially "Y" or "V" shaped forms or one of each; the tops of the substantially "Y"-shaped and/or "V"-shaped forms are joined together, fused or one part; the bottoms of the substantially "Y" and/or "V"-shaped forms are fastened, joined fused or in one part to a waist strap forming means; the waist strap forming means preferably having closure means.

V. DRAWING FIGURES

In order that the invention may be fully understood, the novel "harness", the invention will now be described by way of example and with reference to the accompanying drawings in which.

Figure 1:
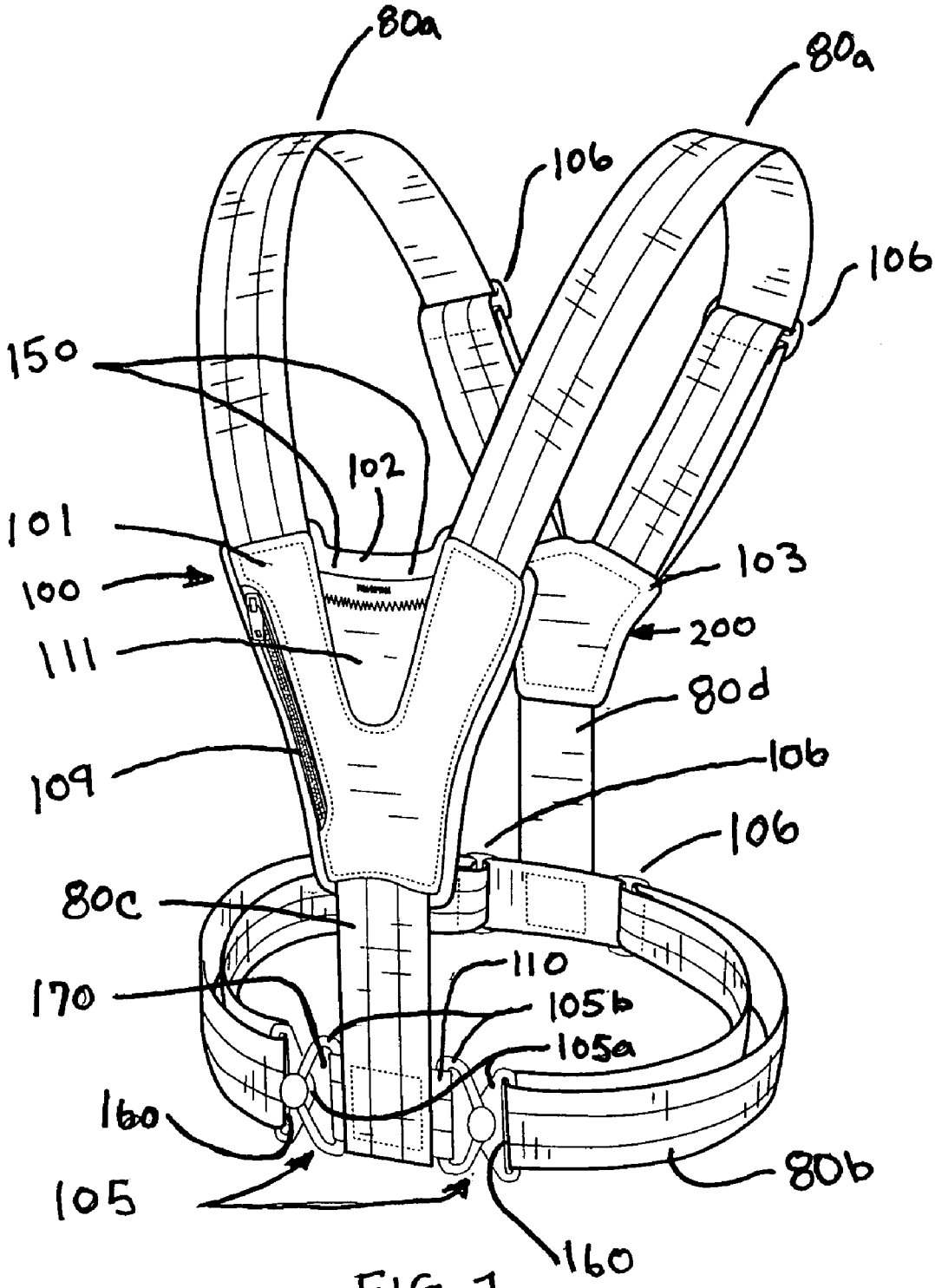
FIG. 1 shows a front perspective view of a preferred embodiment of the disclosed invention with integrated optional pocket forming means.
Figure 6:
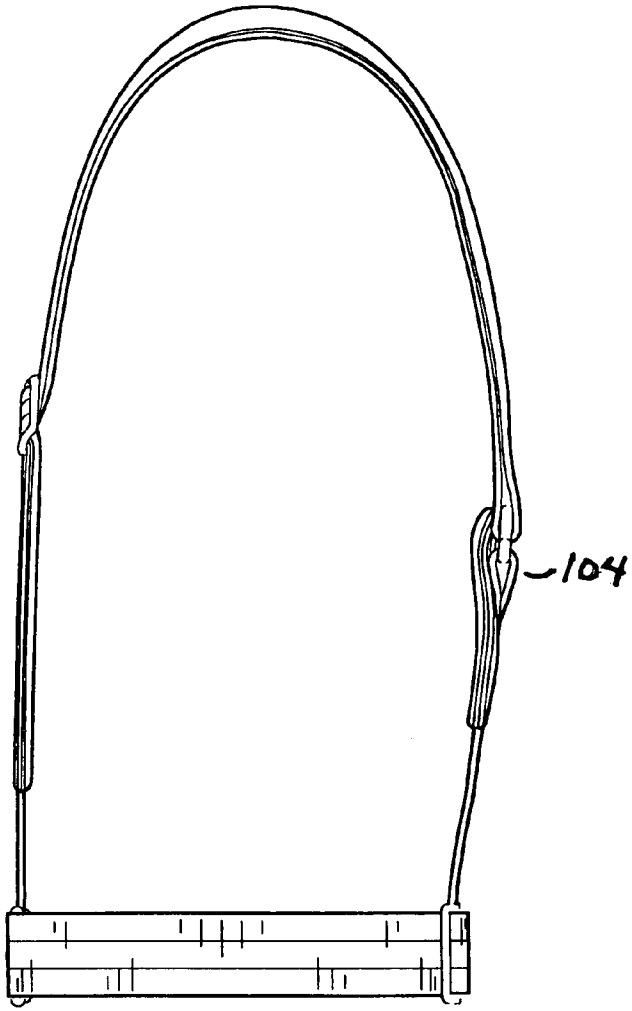
Figure 4:
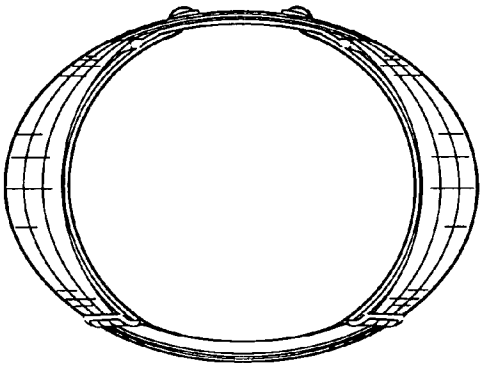
Figure 5:
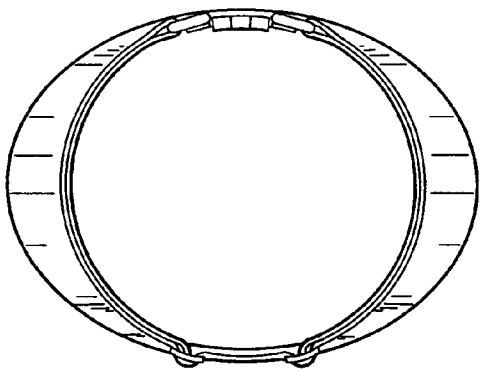
Figure 7:
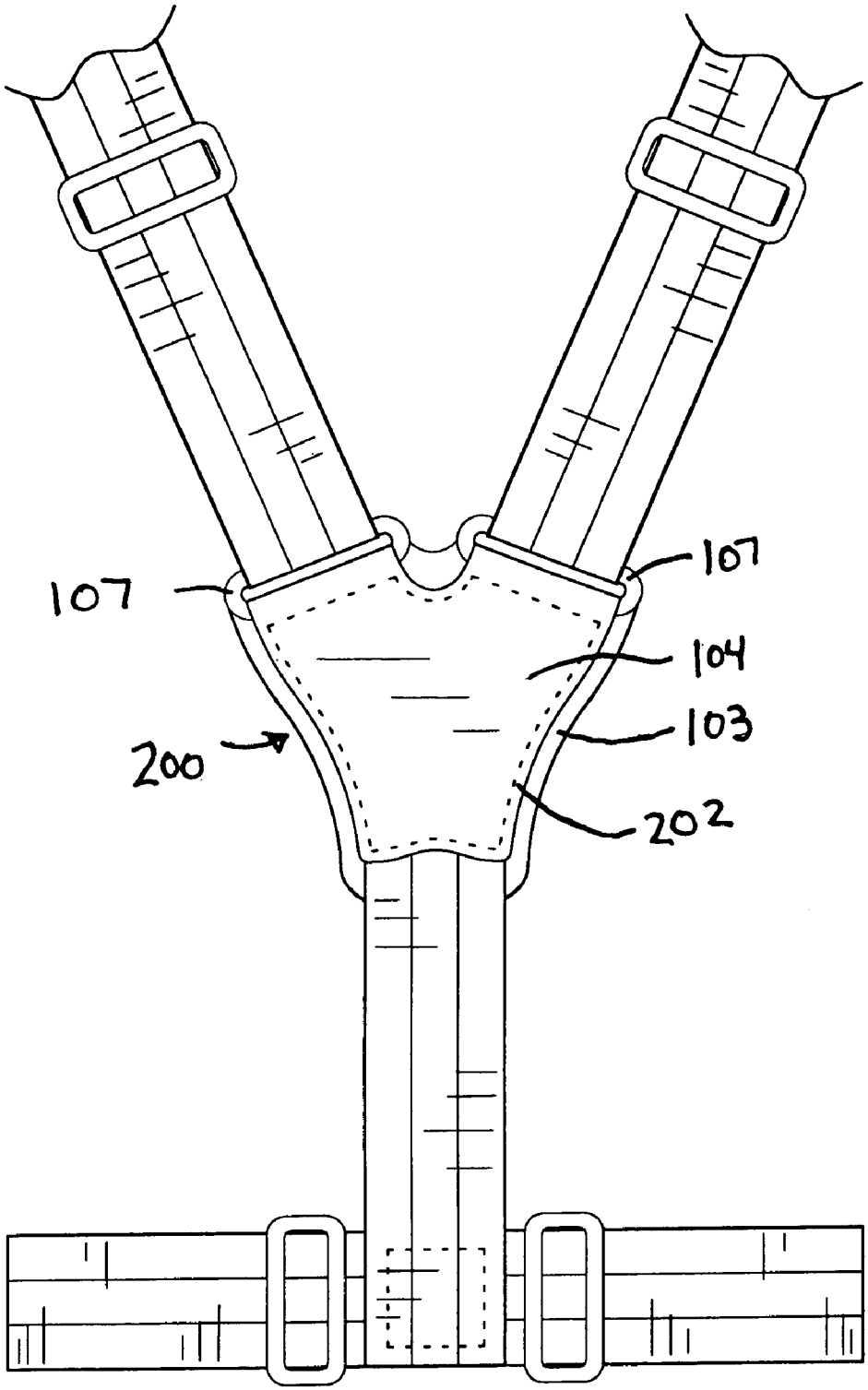

FIG. 4 shows a top view of the embodiment shown in FIG. 1 with adjusters 106 adjusted to fit a small person FIG. 5 shows a bottom view of the embodiment shown in FIG. 1 with adjusters 106 adjusted to fit a small person FIG. 6 shows a right view of the embodiment shown in FIG. 1 with adjusters 106 adjusted to fit a small person; the left side being a mirror image thereof FIG. 7 shows a back view close-up of the embodiment shown in FIG. 1 (with shoulder straps shown cut short to fit on page).

Figure 8:
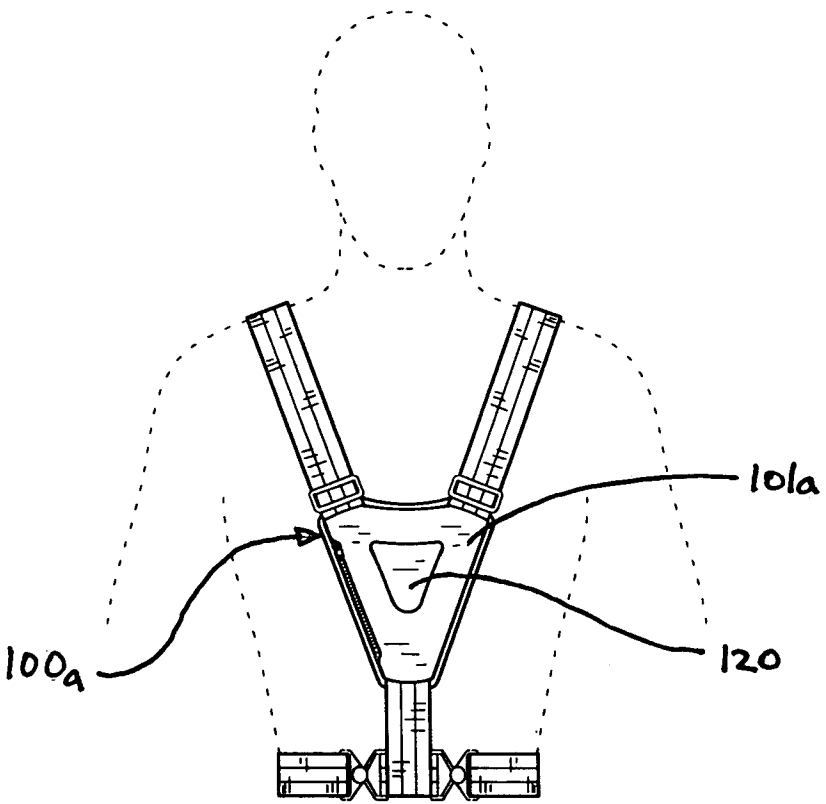

FIG. 8 is a front view of the embodiment shown if FIG. 1 with minor geometric changes to pocket forming means.

Figure 9:
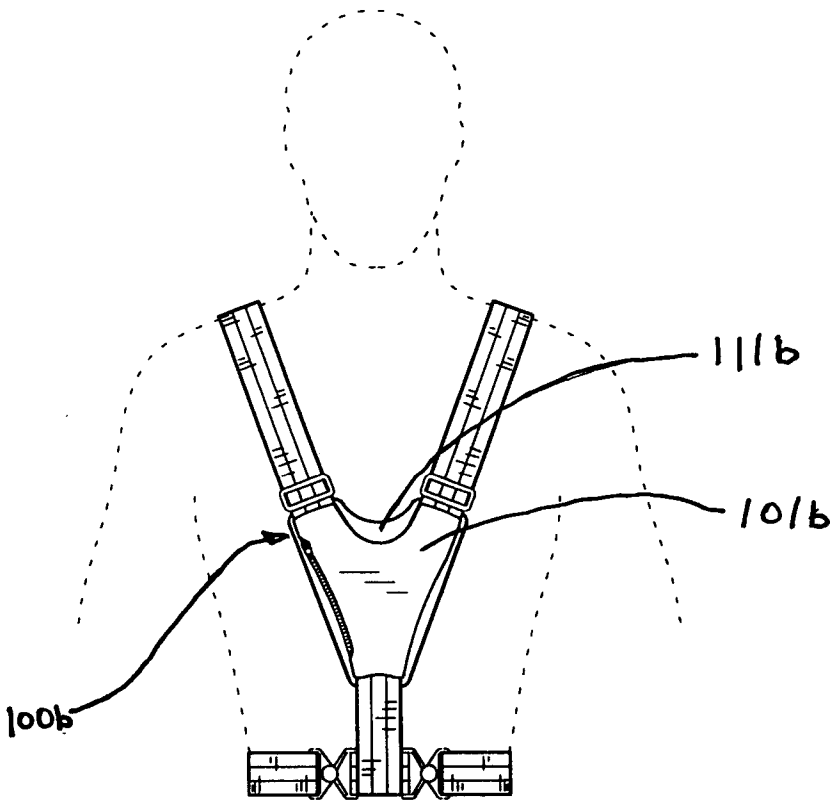

FIG. 9 is a front view of the embodiment shown if FIG. 1 with minor geometric changes to pocket forming means.

Figure 10:
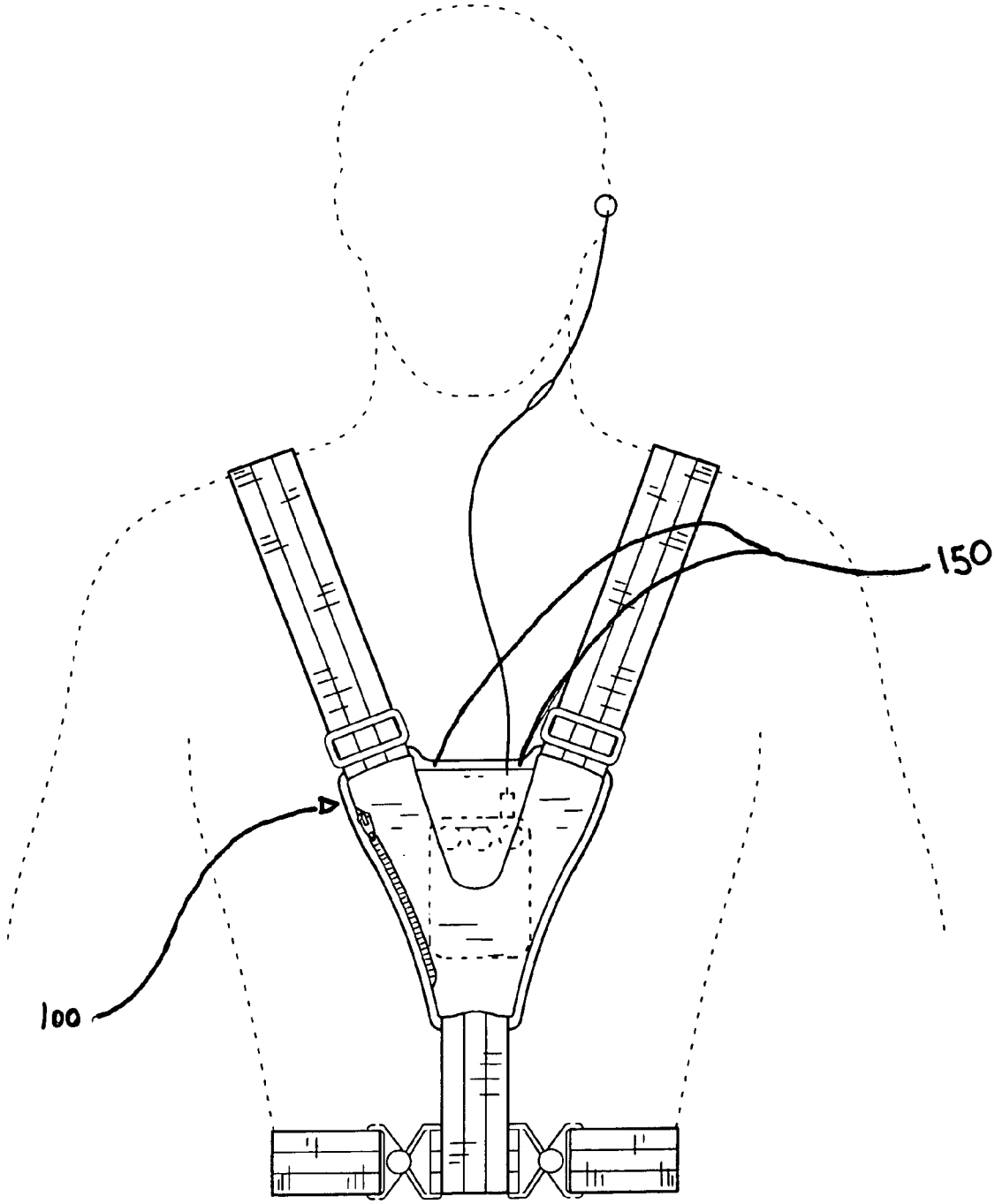

FIG. 10 is a front view of embodiment shown in FIG. 1 that shows a person using an electronic device that feeds a wire (or wires) through a pass-through hole.

Figure 11:
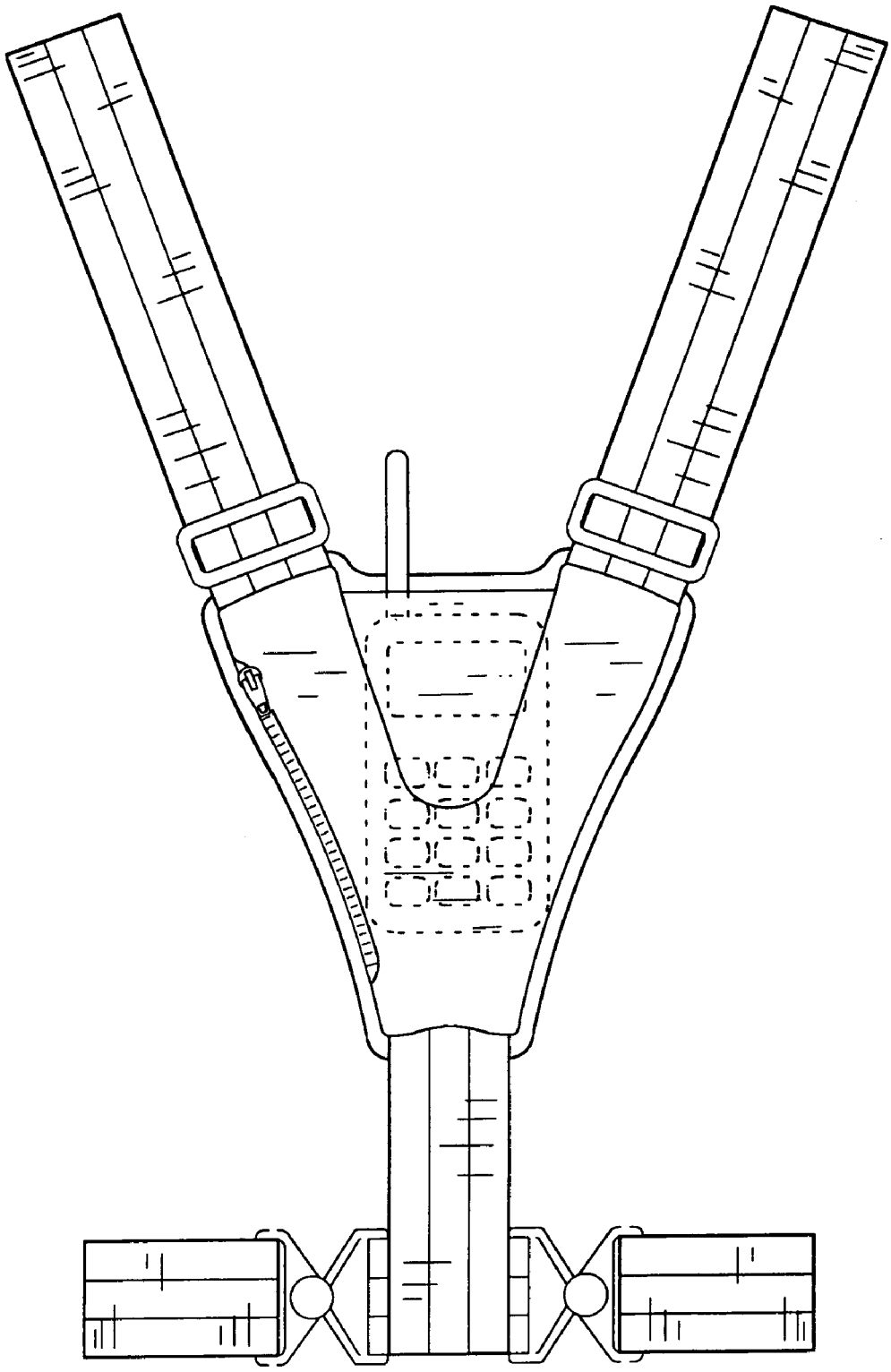

FIG. 11 is a front view of embodiment shown in FIG. 1 that shows an electronic device in the pocket with an antenna or the like sticking through a pass-through hole.

Figure 12:
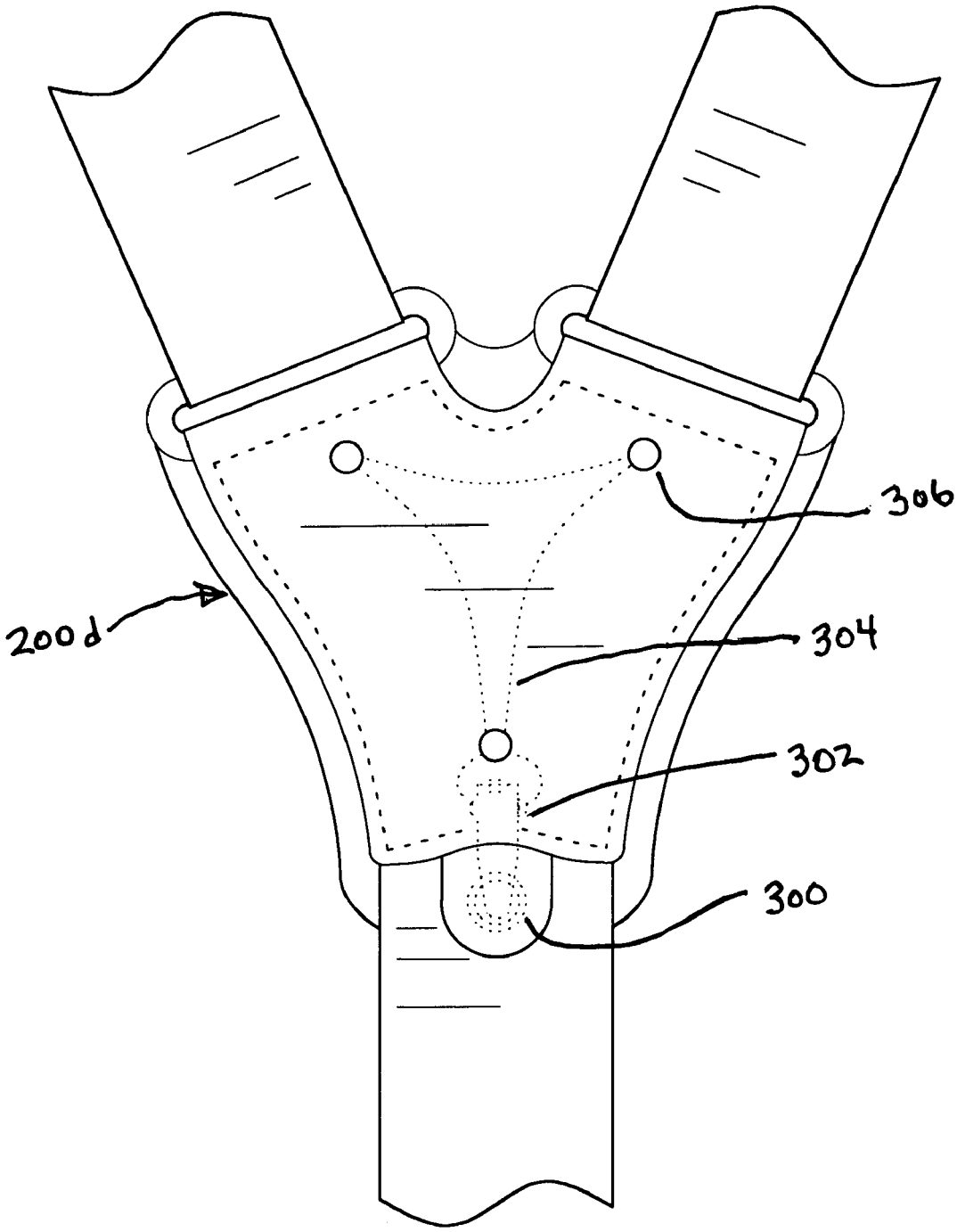

FIG. 12 is a back view of an embodiment similar to FIG. 1 (straps shown cut short to fit on page) with integrated illumination elements and power supply.

Figure 13:
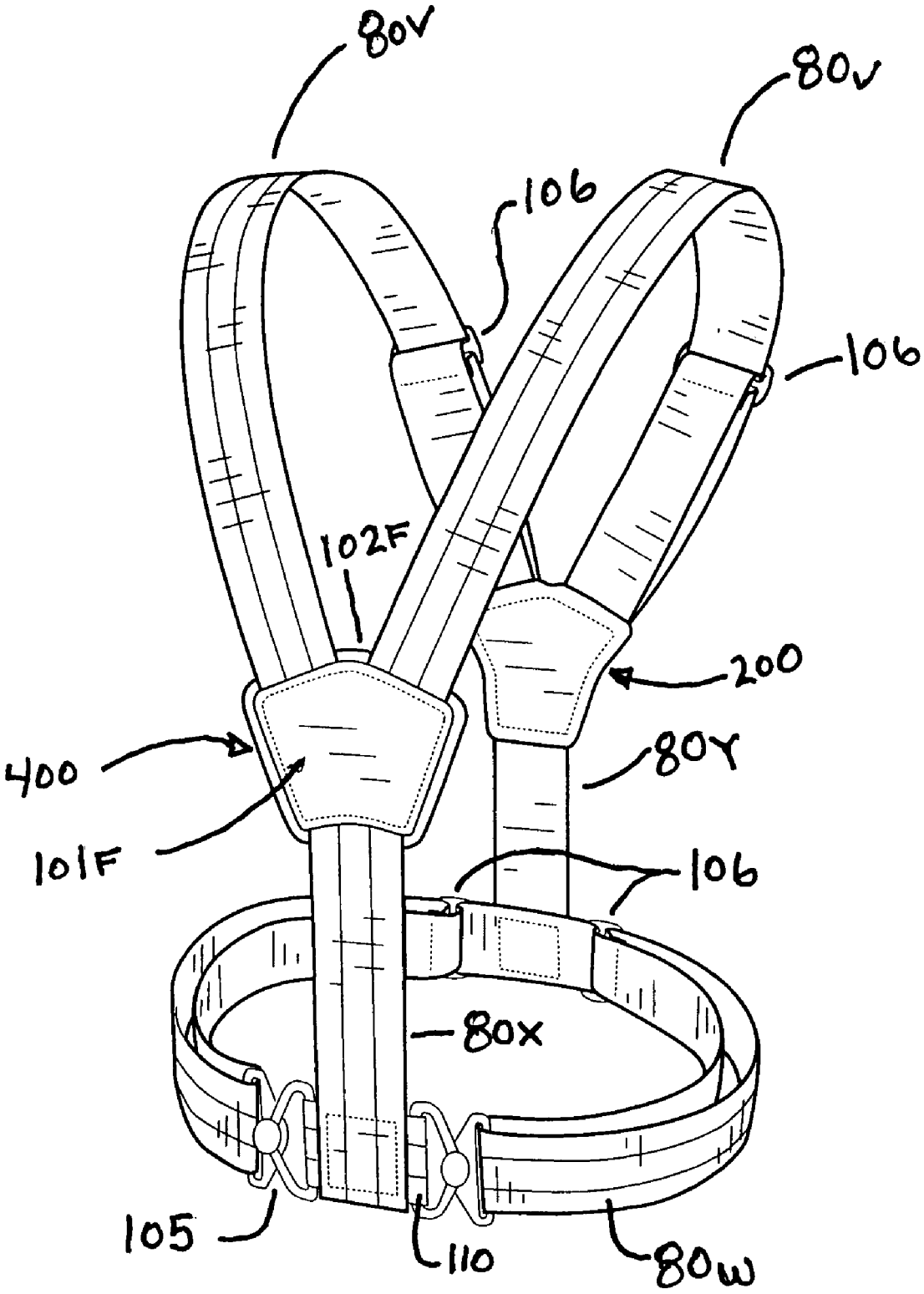

FIG. 13 shows a front perspective view of a second preferred embodiment of the disclosed invention.

Figure 3:
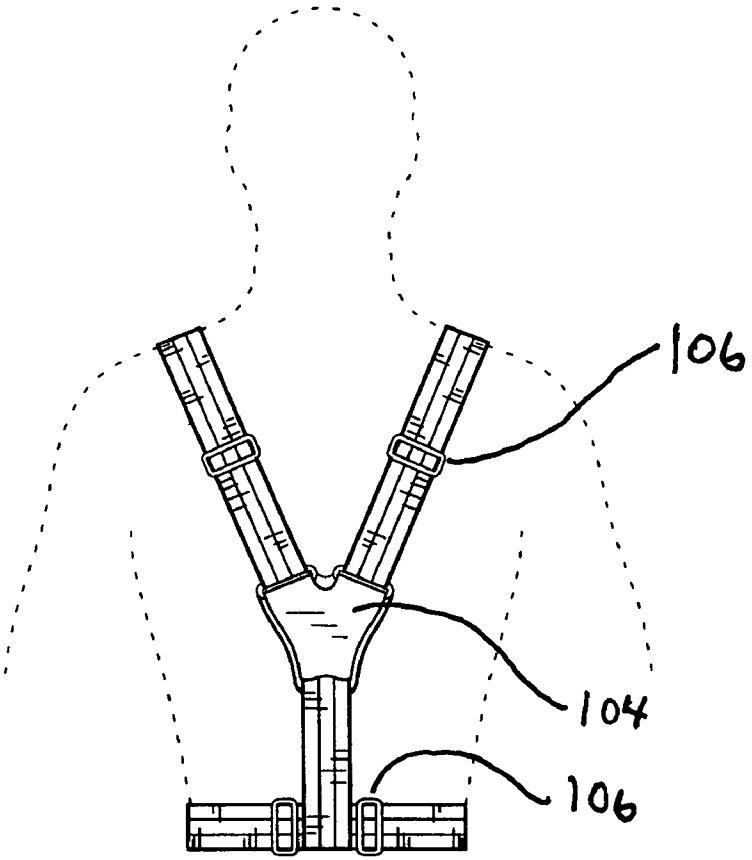
FIG. 3 shows a back view of the embodiment shown in FIG. 1
Figure 14:
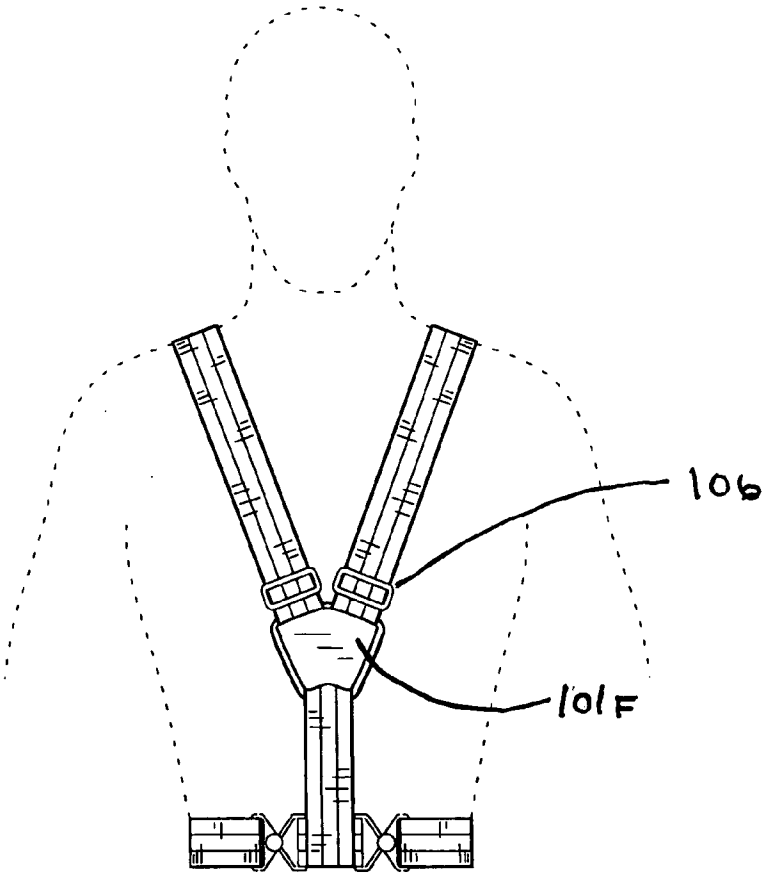

FIG. 14 shows a front view of the second embodiment shown in FIG. 13 with adjusters 106 adjusted to fit a small person. It is important to note that the adjuster loops elements 107 could be fastened to the front or rear central panels depending on the desired adjustment direction (although the preferred configuration is pictured in this embodiment); FIG. 3 shows a preferred back view of the second embodiment shown in FIG. 13

Figure 15:
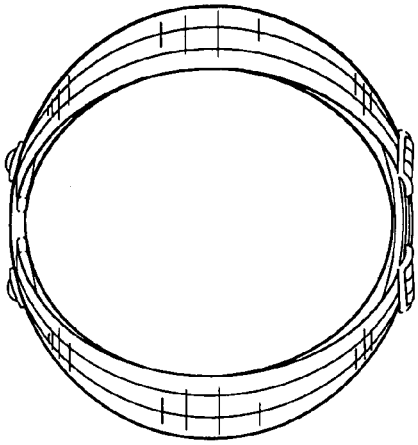

FIG. 15 shows a top view of the embodiment shown in FIG. 13 with adjusters 106 adjusted to fit a small person.

Figure 16:
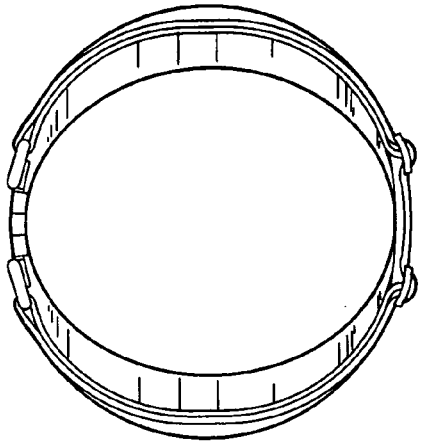

FIG. 16 shows a bottom view of the embodiment shown in FIG. 13 with adjusters 106 adjusted to fit a small person.

Figure 17:
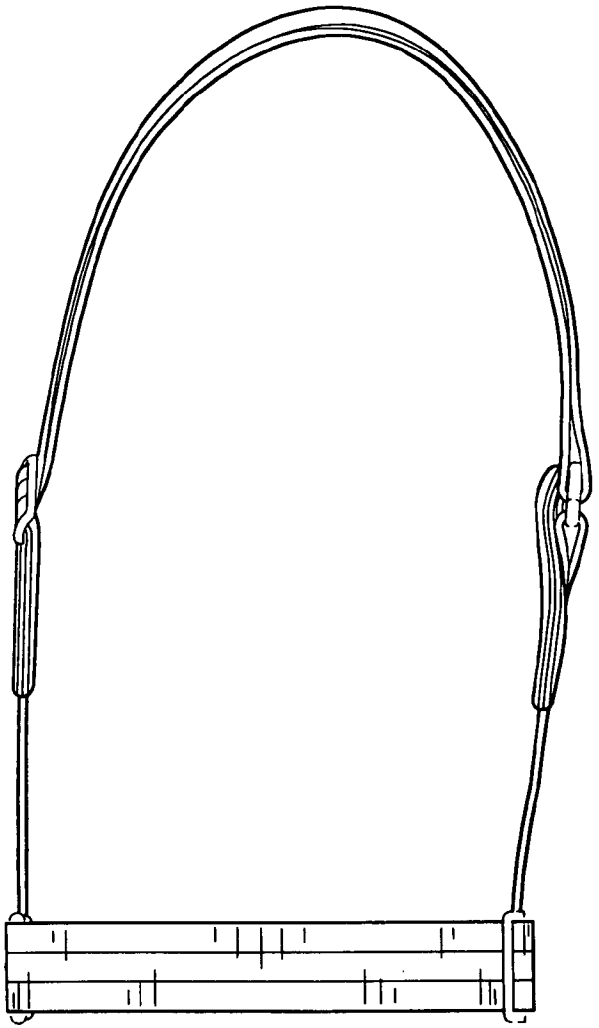
Figure 18:
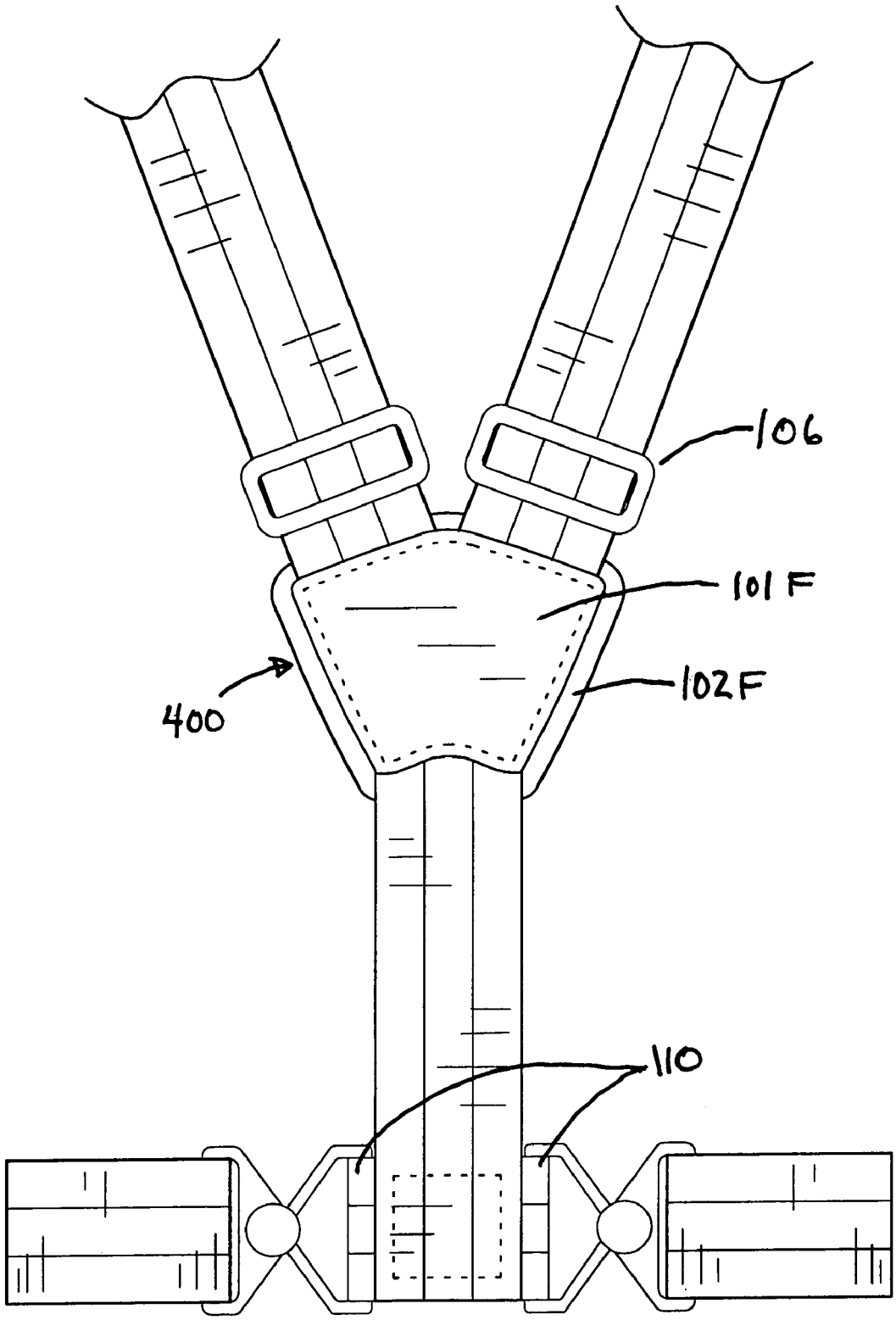

FIG. 17 shows a right side view of the embodiment shown in FIG. 13 with adjusters 106 adjusted to fit a small person; the left side being a mirror image thereof FIG. 18 shows a front view close-up of the second embodiment shown in FIG. 13 (shoulder straps shown cut short to fit on page).

Figure 19:
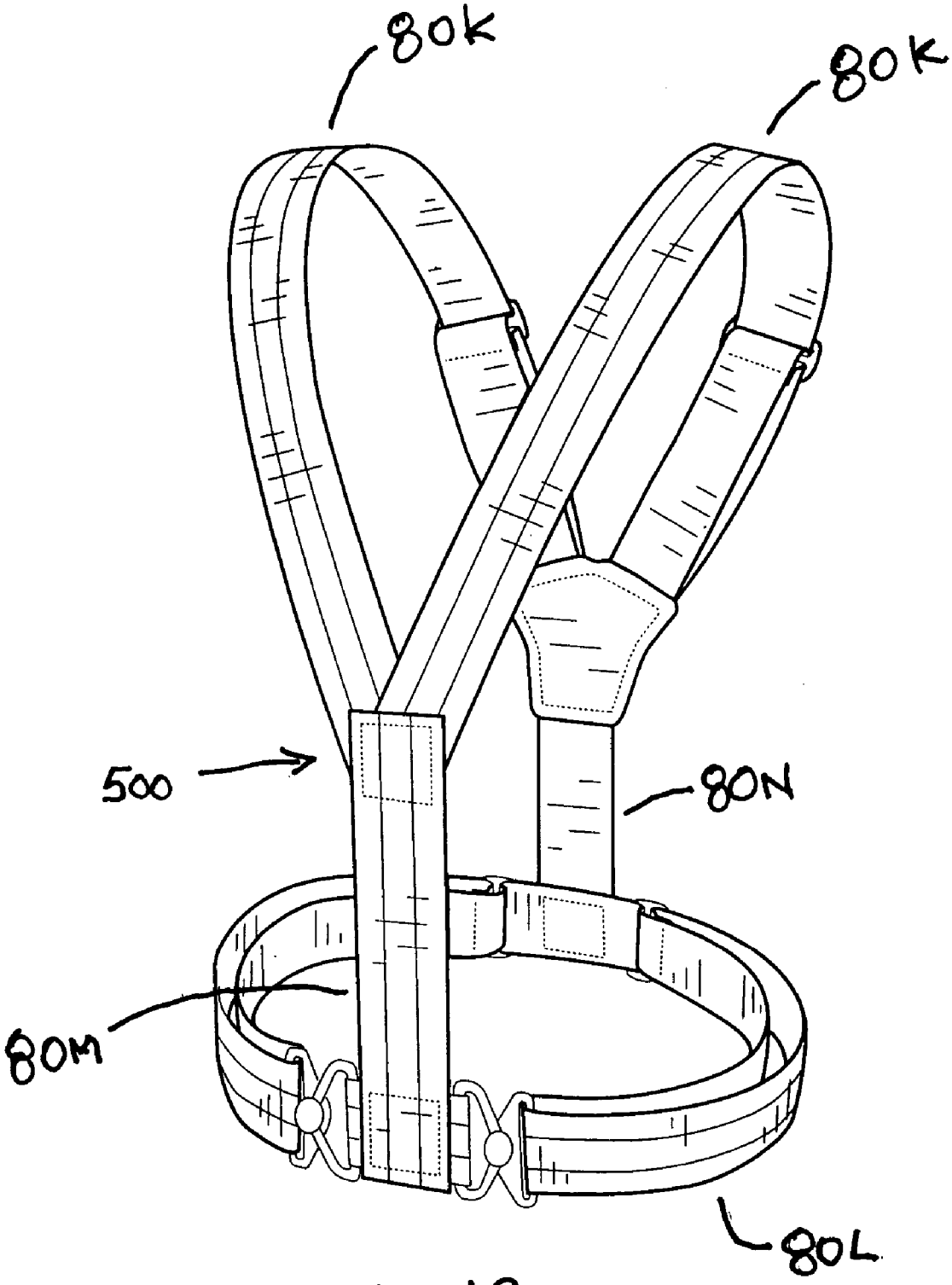

FIG. 19 shows a front perspective view of another embodiment of the novel "harness" without front panel element(s).

Figure 20:
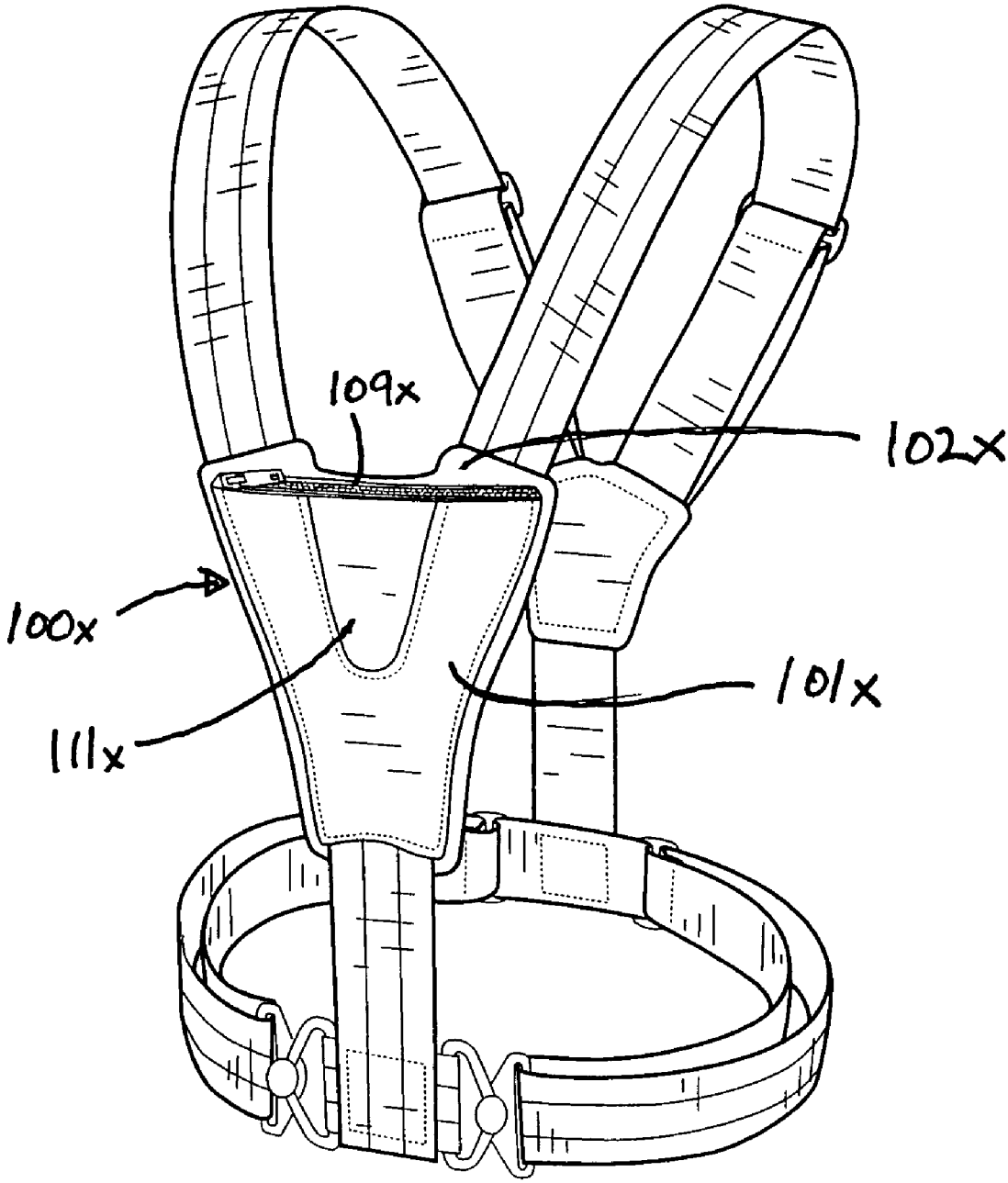

FIG. 20 shows a front perspective view of another embodiment of the novel "harness" with a zipper closure across the top of a panel/utility pocket forming means.

Figure 21:
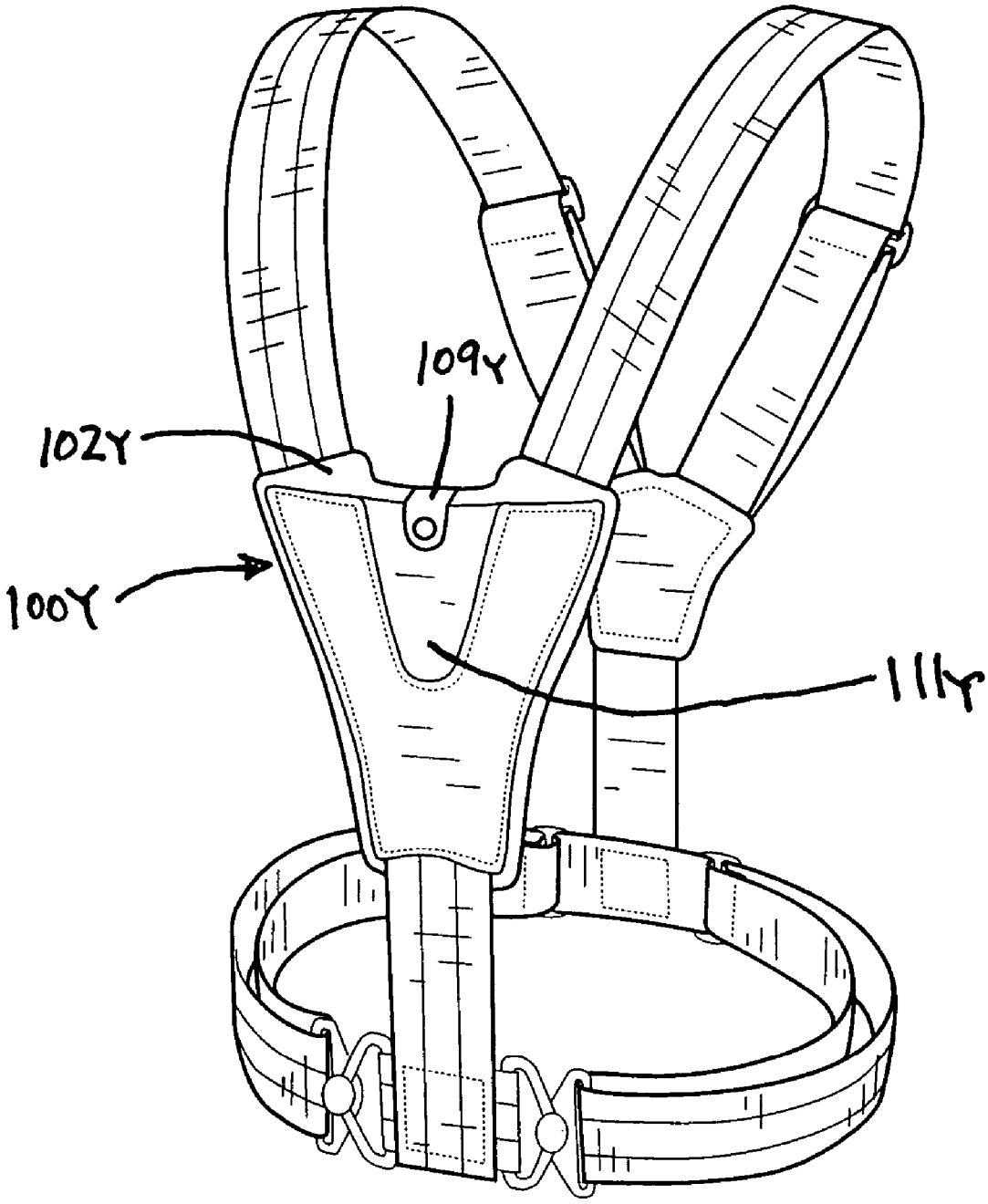

FIG. 21 shows a front perspective view of another embodiment of the novel "harness" with a snap, Velcro, button or other tab closure across at the top of the mouth of a panel/utility pocket forming means.

Figure 22:
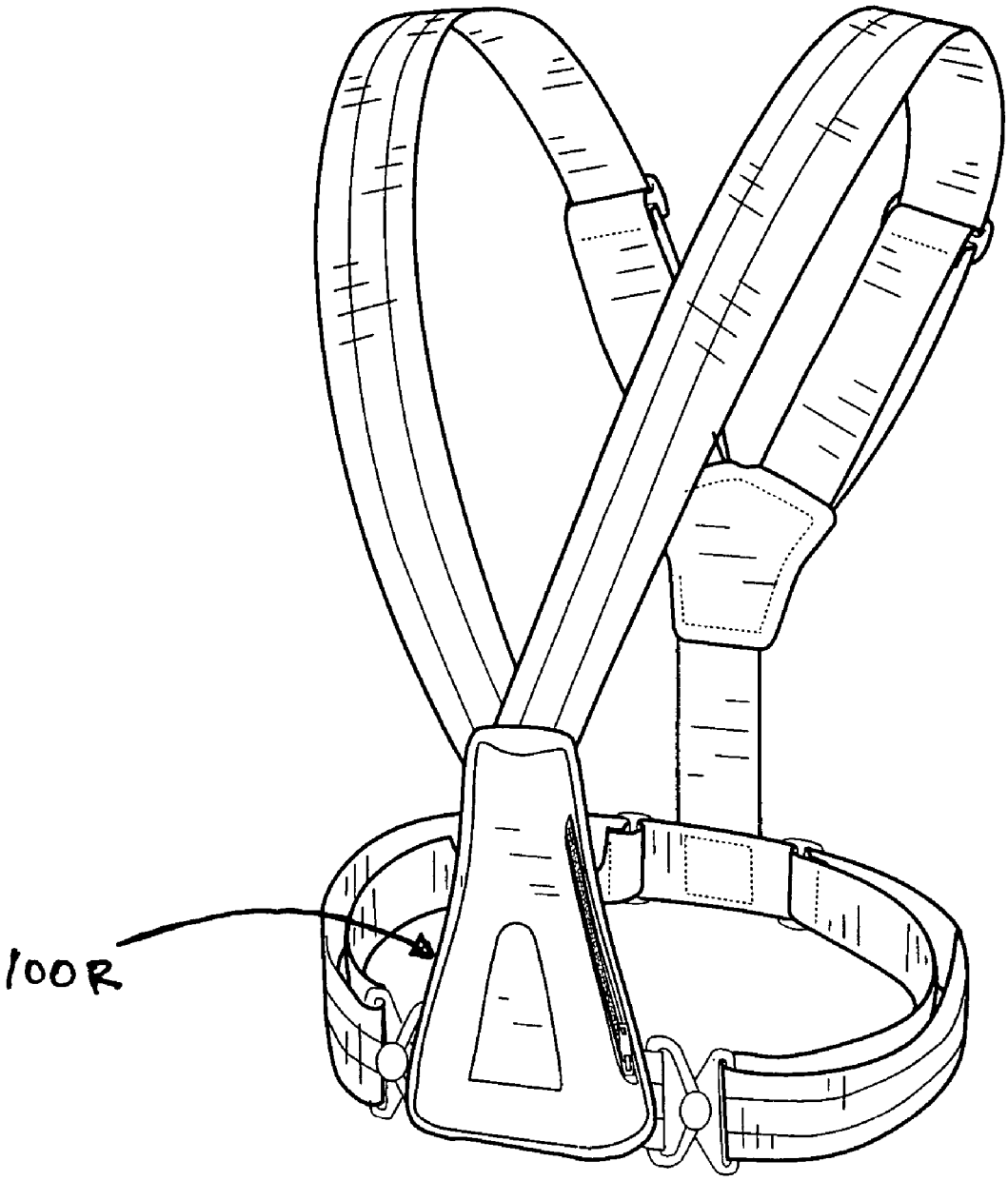

FIG. 22 shows a front perspective view of another embodiment of the novel "harness" with a more reverse triangle shaped front panel/utility pocket forming means.

Figure 23:
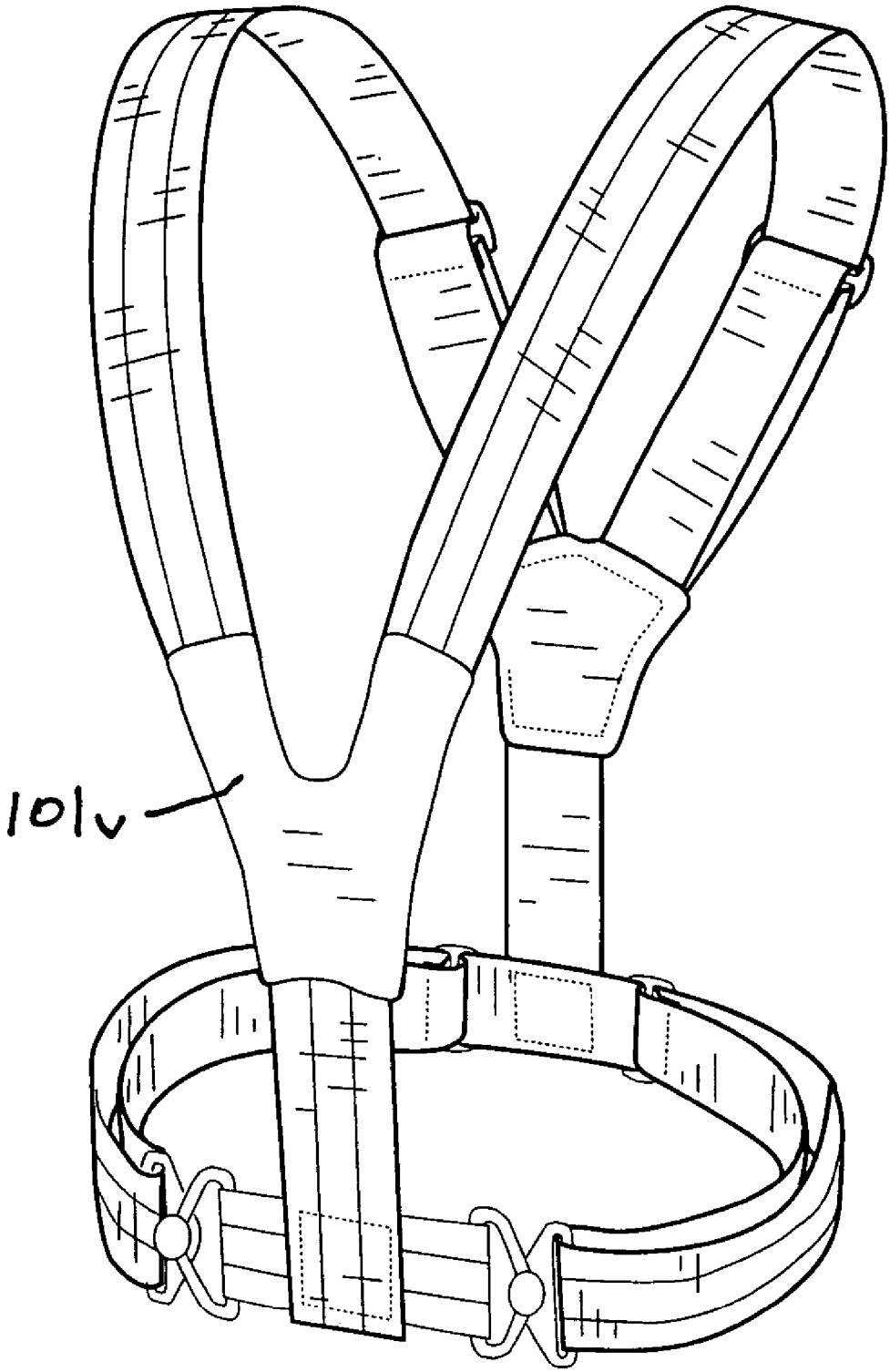

FIG. 23 shows a front perspective view of another embodiment of the novel "harness" with a simple "V" shaped front visibility/utility panel 101*v*.

Figure 24:
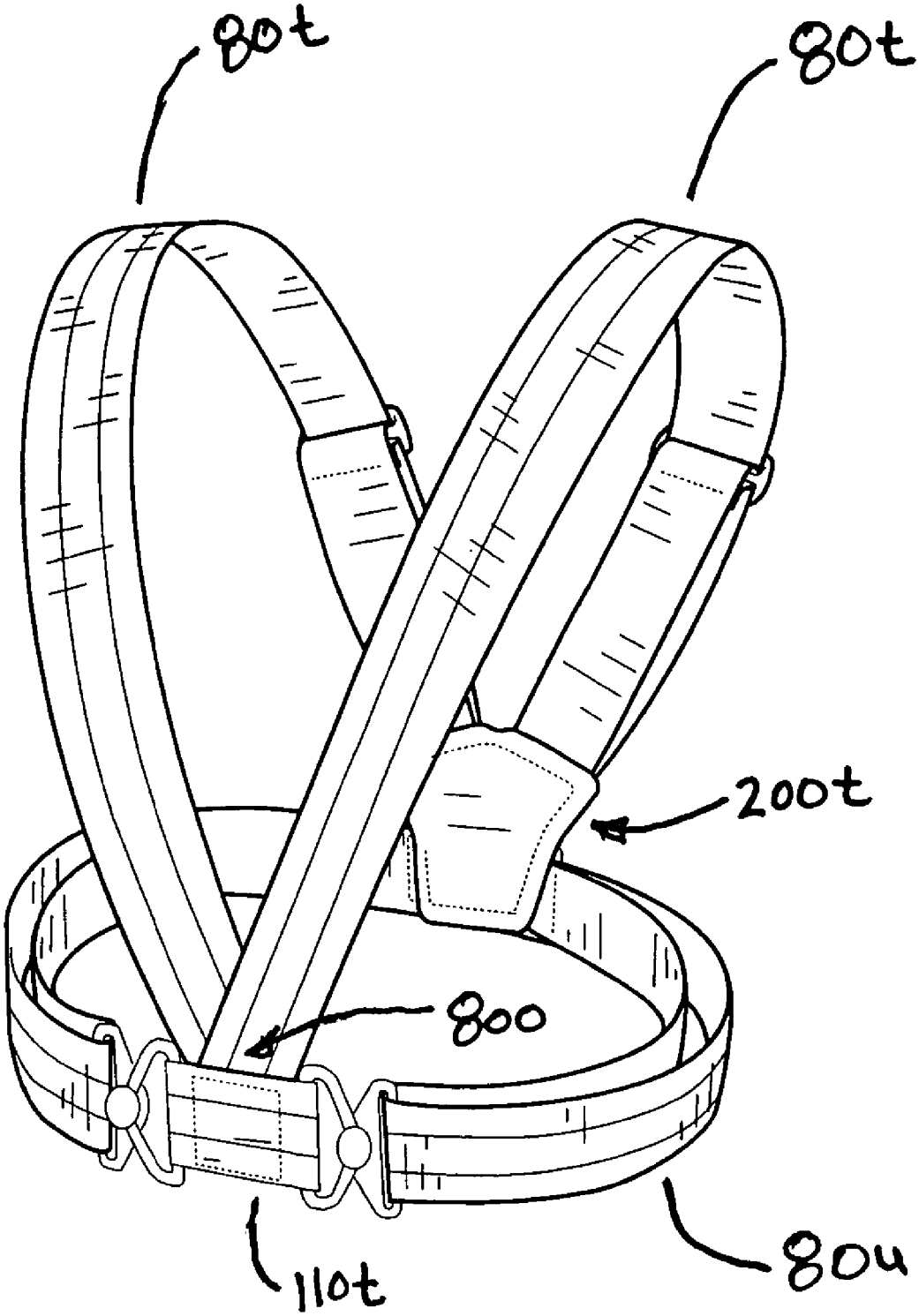

FIG. 24 shows a front perspective view of another embodiment of the novel "harness" (although less preferable) with a simple "V" shaped strap or strap like configuration.

Figure 25:
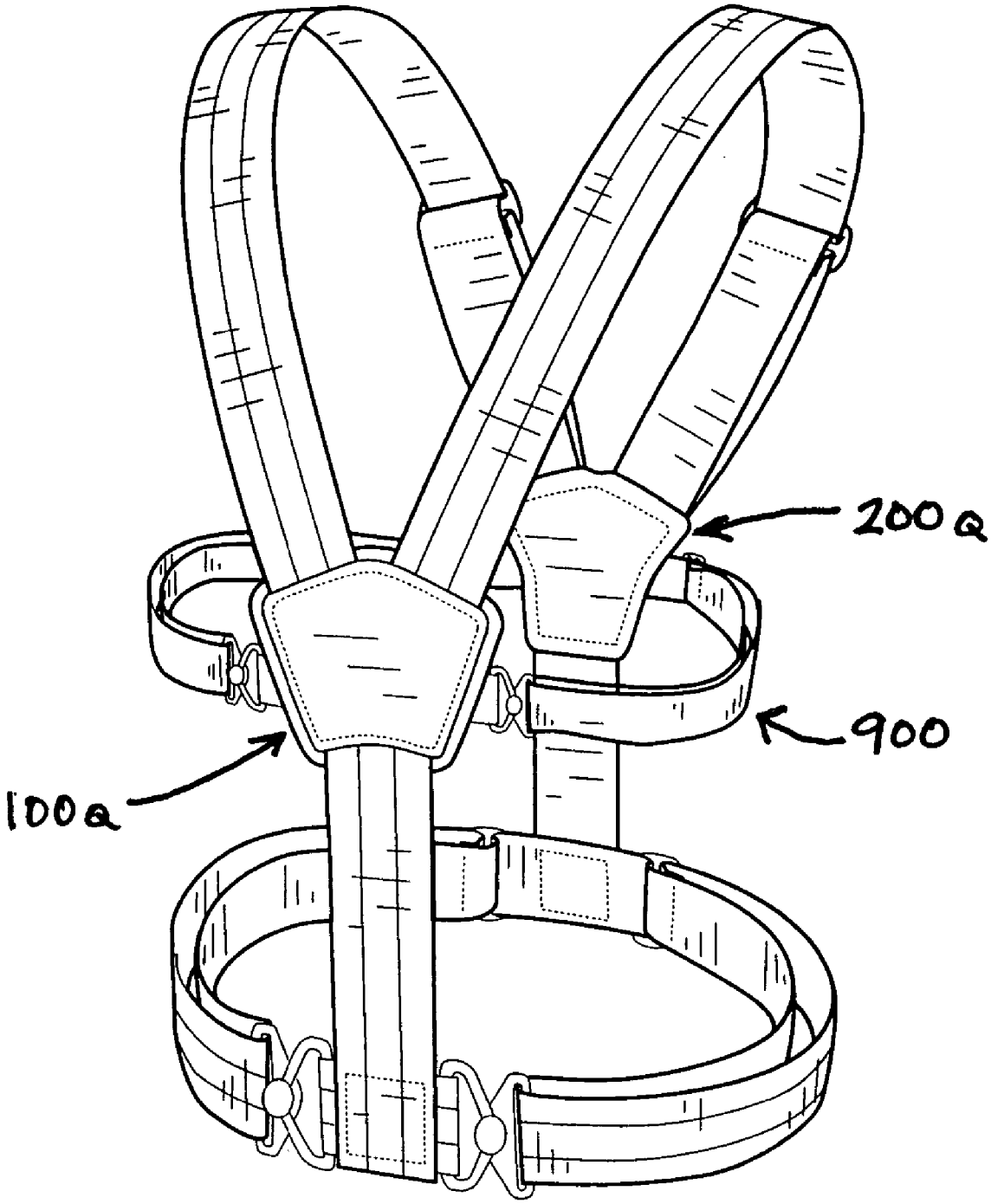

FIG. 25 shows a front perspective view of another embodiment of the novel "harness" with a chest straps 900 or the like added.

Figure 26:
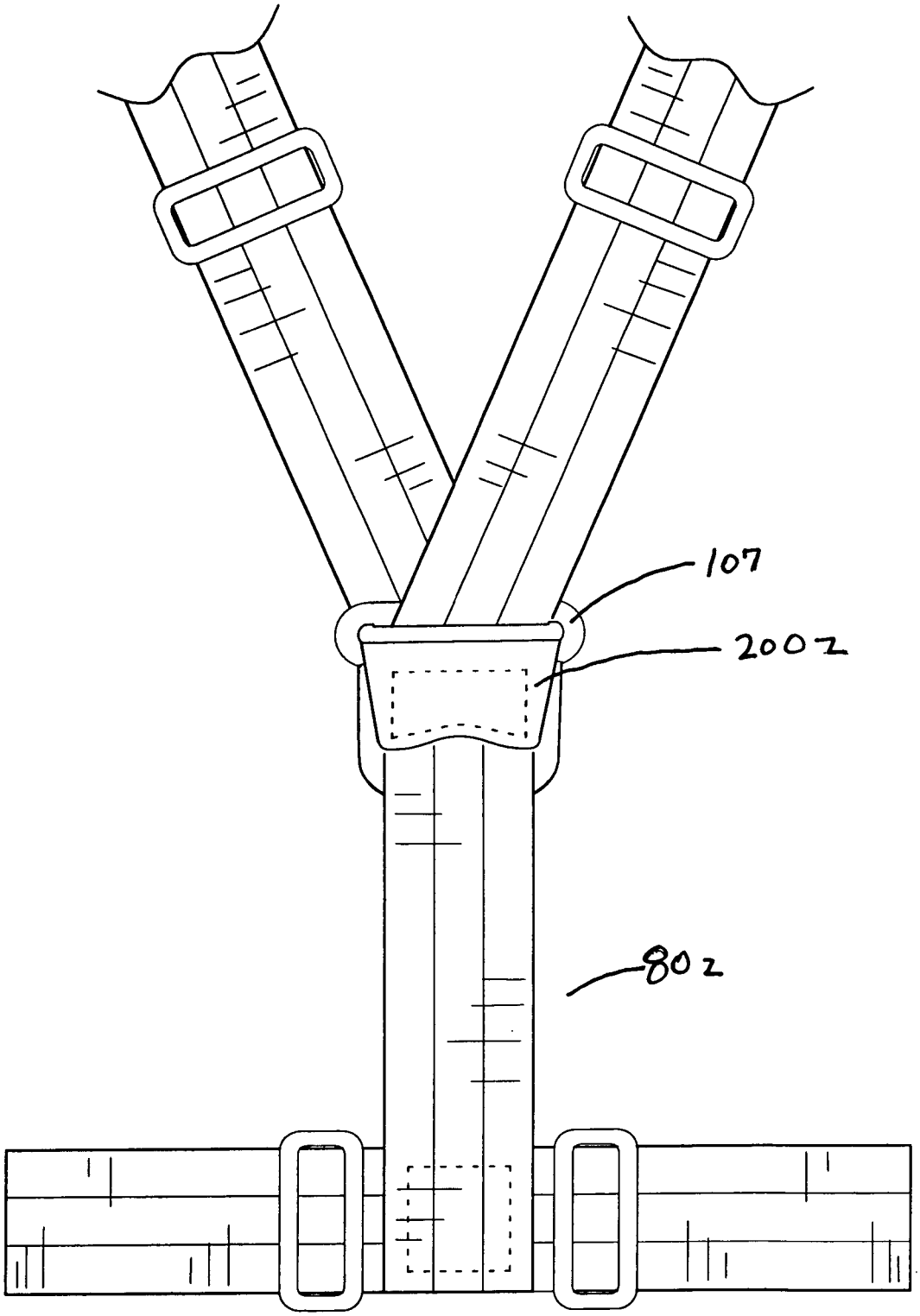

FIG. 26 shows a back view of an embodiment with a simple pass through shoulder strap configuration allowing both shoulder straps to be made of one continuous strap or strap like element.

Figure 27:
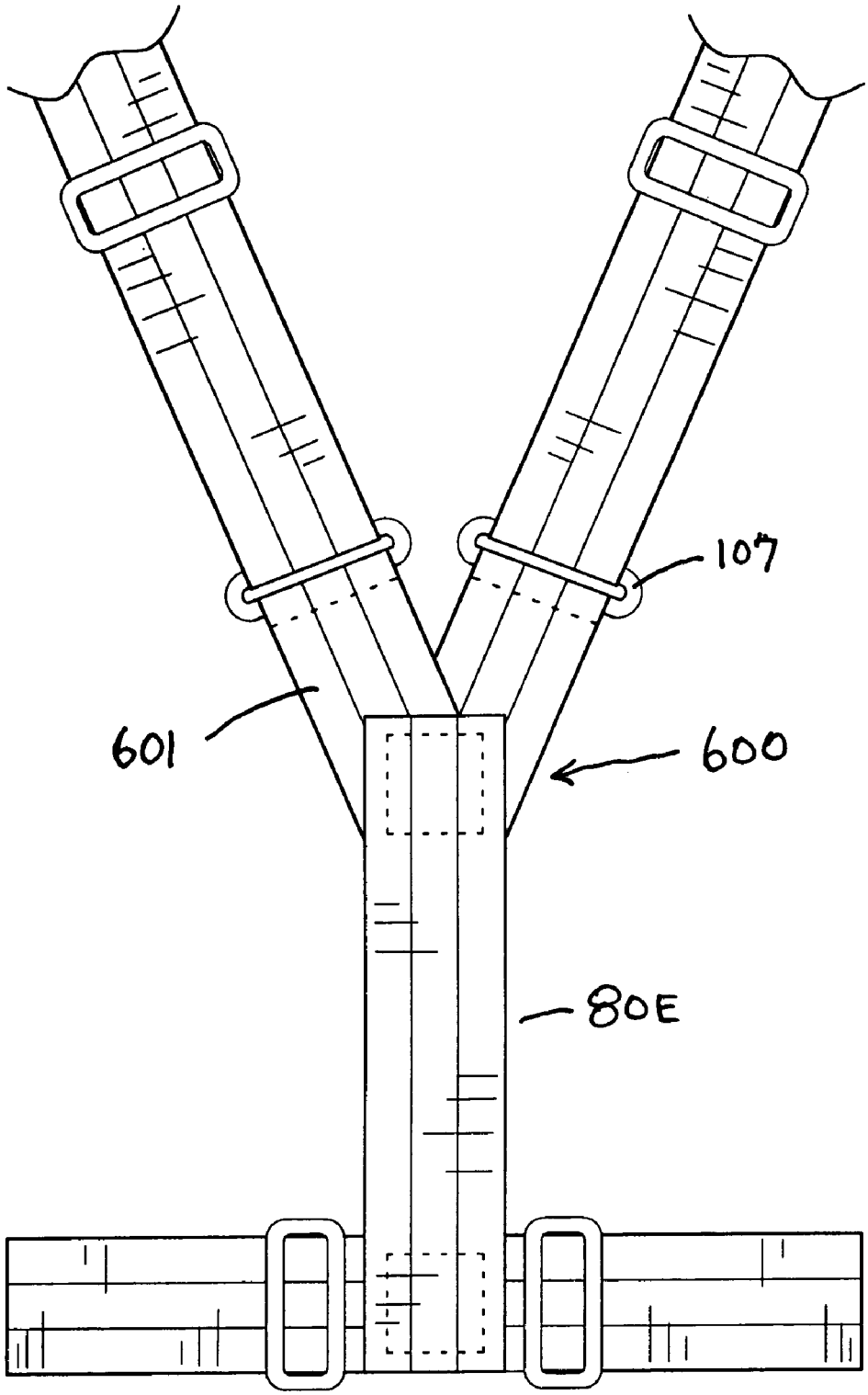

FIG. 27 shows a back view of an embodiment with central visibility element changed out for "Y" strap configuration with affixed pass-through loops for shoulder strap elements.

Figure 28:
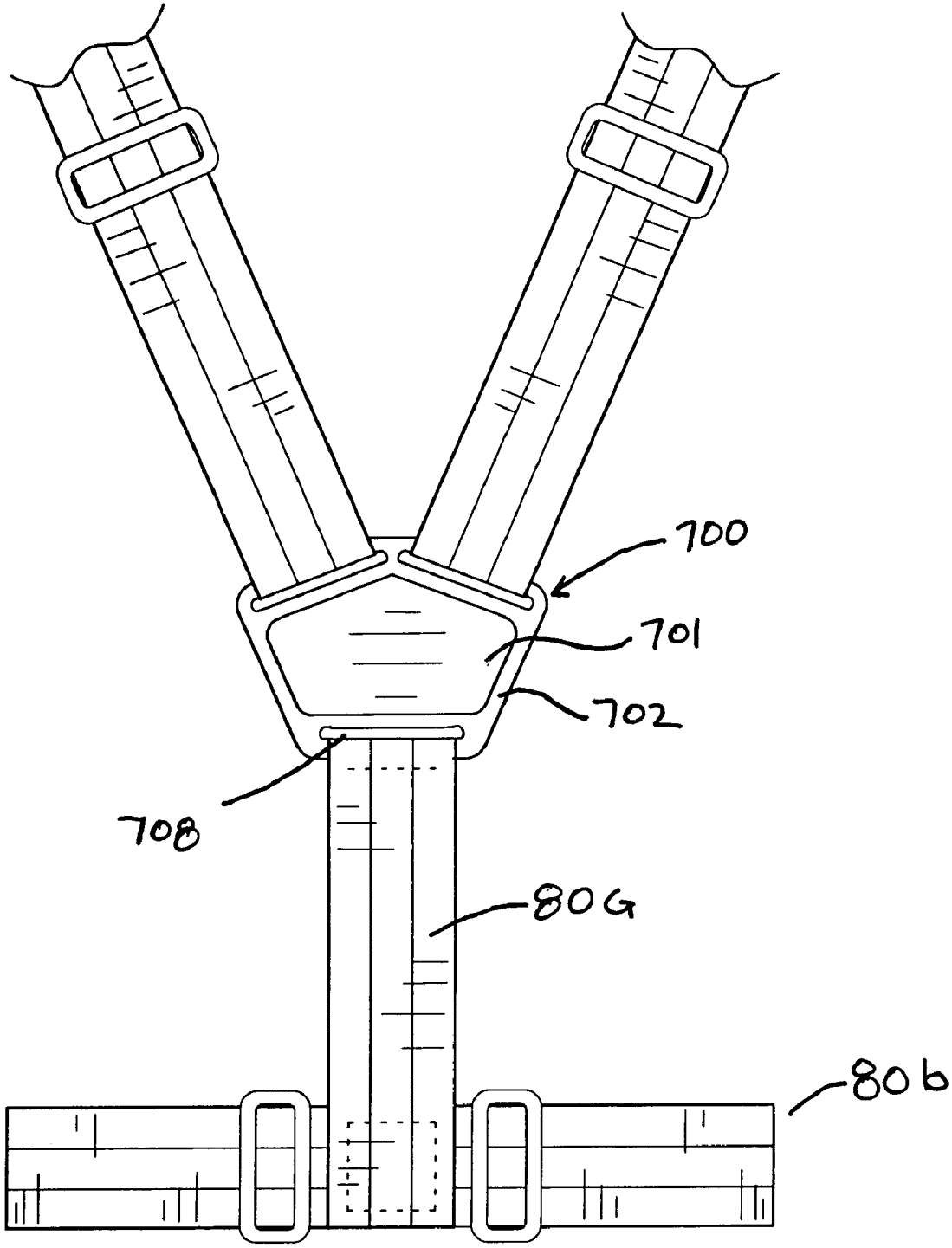

FIG. 28 shows a back view of an embodiment with molded central visibility element/integrated pass-through slots. An element like 700 could be used in the front as well to replace visibility element 400. Element 700 could contain illuminating, flashing or the like elements with the associated electronics and power supply elements (preferably a battery or other power source or the like, see FIG. 12)

While the invention has been described by reference to illustrative embodiments, it is not intended that the novel device be limited thereby, but that modifications thereof are intended to be included as falling within the broad spirit and scope of the foregoing disclosure, the following claims and the appended drawings.

VI. DESCRIPTION—PREFERRED EMBODIMENT

The following discloses a novel "harness" which is designed to be worn on the user's body as depicted in the Figures included.

The "harness" shown in the figures included is generally designed to be worn while the user participates in a variety of activities. A primary function for the novel disclosed "harness" in one embodiment is a means for providing visibility of the user in low light or other situations in which the user would want to be seen. Another function in one embodiment for the novel disclosed harness is to provide the user a means for carrying an item or items (carrying means—a pocket—is disclosed in the following description and drawings). The location and geometry of the pocket is also believed to be novel and provides many benefits to the user.

The preferable front and/or rear somewhat central visibility (or other function-oriented) elements provide a central area to integrate many features that the wearer may desire like electronic features: audio, heart rate monitor, medical device(s), tracking devices, a timer or clock(s), light or lights, etc. Although a primary function of the novel "harness" is high visibility, the structure and geometry of the harness is believed to be novel and provides many benefits for carrying objects in an integrated pocket or integrated, clipped, or fastened in some other way to one or both of the somewhat central panel/areas where the three strap ends meet in the disclosed "Y" shape.

Important to this novel design is its ease of manufacturing. It can be constructed using inexpensive and easily obtained materials, assembled using conventional manufacturing equipment, produced easily and inexpensively.

The general geometry, materials and construction of the novel "harness" is as follows:

The "harness" can be constructed from a variety of materials, colors, etc. In describing the disclosed novel "harness" you could generally say there are three main areas of components: the strap or strap-like elements, the buckling/adjusting means elements and the central panel(s) (or visibility and/or utility area(s)—potentially housing features like item carrying/holding means, integrated electronic items/visibility lights or the like etc.)

The strap or strap like elements are preferably made from somewhat flexible material like stretchy webbing (commonly used in suspender straps, waist band elastic, or the like). The straps are preferably made of a bright color to enhance visibility and preferably have integrated light reflectivity (which can take many forms some include: heat or the like applied reflective strip (like 3M scotchlite), screened on reflective ink or the like, woven in reflective elements or could be made from a wholly or partially reflective material) or high visibility or reflective materials or elements sewn, screened, printed or otherwise adhered directly to strap elements. There are many options for the strap like elements, some examples are: nylon webbing, cut strips of material like neoprene, nylon, cotton, mesh etc or the like could be used in combination or by themselves with or without integrated reflective material. A variety of different materials in combination could be used for the strap-like elements for example nylon or the like webbing could be used for the shoulder straps in combination with stretch webbing for the waist straps or different materials to achieve a desired result. Stretch webbing/waist band elastic may want to be combined with nylon or the like webbing to get stretch in a localized area but no stretch in another (as well as potentially using a less expensive material for certain areas in combination with other materials to get a certain result.) Also these strap like elements instead of having straight edges could be sculpted in a number of ways, going from thin strapping to thicker in certain areas, could have substantially sinuous edges or bulge out or in (they could potentially be formed to fit better with the user's body). elements 80*c* and 80*d* could sculpt in a somewhat hourglass shape, bulge outward like the head of a cobra, etc. Another way the novel "harness" could be produced is by weaving, molding, fabricating, die-cutting or the like some or all the strap like elements together in one part (or more parts), then adding/combining components (if desired) by sewing weaving, gluing, etc. or the like. It can be understood that there are many ways of manufacturing the novel disclosed "harness" within the scope of the invention by combining, dividing, adding, removing, parts, pieces, features etc.

The buckling/adjusting means elements can be made from commonly available off-the-shelf buckles and adjusters used for belts, backpacks, bags, suspenders, etc. or the like to allow adjustment for height and/or girth. Although off-the-shelf buckles are depicted in the embodiments shown it can be easily seen that these buckles could be replaced with a multitude of fastening means. Hook and loop closures (velcro or the like), snaps, buttons, zippers, ties, eye-hooks, hooks with mating means, etc or the like could easily be integrated sewn, stitched, glued, grommeted, etc in such a way that they provide the same or similar buckling/closure means. The adjusting means can also be accomplished in many other ways as well. For example fabric loops could be used instead of the disclosed plastic or the like off-the-shelf adjusters, hook and loop, snaps, eyelets with a buckle or the adjusting means could be incorporated into the buckle/fastening means. Also, although not preferable, the buckling and/or adjusting means could be eliminated altogether. There could be different sizes to fit different sized users, the user could put the "harness" on over his/her head and/or different sizes could be accommodated by using stretch or other flexible materials. Also although not preferable one continuous strap can be use for the shoulder strap or strap like elements with the strap sliding through a hole, slit, loop or loop part on or otherwise mounted to the somewhat central visibility/utility area see FIG. 32 for an example of this sort of configuration.

The central panel (visibility and/or utility) area(s) are preferably constructed of flexible light material or the like (although could be made of a less flexible material). The high-visibility surface is preferably constructed of bright reflective material such as commonly available 3M scotchlite or other light reflective materials and can be a variety of sizes and shapes. It can be backed with a soft preferably breathable material (If desired for comfort.) Holes can be punched through this panel to let air more freely pass through or as a pass-through for cables, tubes, electronic components like antennas, etc. or the like. This element (an example is labeled 101) could be die cut, punched, cut from flat stock. It could be injection molded, take the form of a reflector like those used on bicycles, street signs, etc. although it is preferable that these element(s) are light in weight, thin and flexible. It should be noted that although not preferable one or both of these panels could be moveable and/or eliminated and the three strap ends which come together on the front and/or back could join together without the panel and just be sewn together in a somewhat "Y" shape (see FIG. 19 for example). Although not always preferable for some applications or for cost reasons it may be desirable to construct the novel "harness" in this manner without one or both somewhat central visibility panels, see FIG. 19 and FIG. 27.

The preferable front and rear somewhat central visibility elements are sewn or otherwise attached to the strap-like elements and/or the adjustment loops for adjustability. See FIG. 1 for an example of a potential assembly method of these elements (stitching is shown with a dashed line or with zig-zags). Also these strap-like elements and/or adjustment loops can be attached to the somewhat central visibility elements directly or by making a loop out of this central area part or parts itself or via a secondary part such as a piece of webbing strap, etc or other means (see FIG. 7).

The preferable front and rear somewhat central visibility elements can house lighting elements such as LED flashers with their associated power supply (such as a small battery. The LED/light or the like elements could be integrated into a light transmissive material so that the whole front and/or rear somewhat central visibility elements glow/flash/give off light (transmit the light produced by the LED/light or the like element). Also these lighting elements can be integrated into the strap-like elements as well as the buckle or adjuster (or the like) elements. A flexible, somewhat flexible, or somewhat rigid light panel element (or luminous panel or panels) can be incorporated into one or more of these somewhat central visibility elements with associated power supply (battery or the like). There are many off-the-shelf light panel elements that could be integrated that when a voltage is applied to them they produce light. A simple bicycle flashing LED system could be used, one that is preferably waterproofed with potted components, uses a sealing gasket system, etc. or the like for water proofing for use in wet/rainy situations.

An example of a pocket which can be incorporated into the front and/or rear somewhat central visibility elements is disclosed in the figures enclosed. Also disclosed are wire pass-through features which can be used to feed cables, wires, tubes, antennas, etc. or the like through so that the user of the disclosed harness can thread the wires of headphones or the like to a player (music, audio, visual or the like) enclosed in the pocket or pocket-like element(s). The pocket(s) could house a bladder for a liquid, gel or the like and a tube(s) could be feed through the pass-through(s) so that the user could drink or access the tube(s). Also closure means for this pocket is disclosed. The pocket can be closed on one or more sides with a zipper, Velcro (hook and loop fasteners), buttons, overlaps or any number of closure means so that the contents held within the pocket can be accessed by the user.

The herein disclosed "harness" can be assembled together in a multitude of ways use by manufacturers. The primary embodiments pictured are preferably sewn together as shown by dashed and zig-zag sewing lines (shown in FIG. 1, FIG. 13 and FIG. 19—but also shown in others) Although many other assembly techniques/methods can be used like ultrasonic, heat or the like welding, gluing, Velcro (or the like), grommeting, weaving some or all of components together in place or the like as well as many other assembly techniques found in manufacturing.

The embodiments described herein have been contemplated for purposes of illustrating the principals of the present invention. Accordingly, the present invention is not to be limited solely to the exact configuration and construction as illustrated and set forth herein.

VII. DETAILED DESCRIPTION OF DRAWINGS

References will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Referring to FIG. 1, there is shown a perspective view of a preferred embodiment of the disclosed invention with integrated optional pocket forming means. One end of preferably bright reflective or the like straps or strap-like elements 80*a* pass through 107 (see FIG. 7), plastic, metal or the like loops or the like and are affixed at the strap end, glued, sewn, heat bonded or the like to the inner rung of plastic, metal or the like adjuster elements 106 (commonly found on most backpacks) which have been feed onto straps or strap-like elements 80*a*. The other end of straps or strap-like elements 80*a* are affixed glued, sewn or the like to 100, pocket forming means preferably sandwiched between 101, reflective sheet or the like and 102 non-chafing fabric or the like. Pocket forming means 100 is created when fabric or the like element 102 and preferably reflective sheet material or the like element 101 with stretch mesh window or the like 111 sewed, glued or the like to it are sewed, glued or the like affixed together at their periphery except in small pass-through areas/openings 150. Zipper closure or the like

109 is affixed, sewn, heat bonded, integrally molded/formed, etc to 101 and 102 so that it acts as a closure for the pocket which is formed therein between elements 101,111 and 102. One end of preferably bright, reflective, strap or strap-like element 80*d* is affixed, glued, sewed, heat bonded or the like somewhat centrally to strap or strap-like element 80*b* and the other end is affixed, glued, heat bonded or the like to central visibility element 200 preferably sandwiched between non-chafing fabric or the like element 103 and preferably reflective element 104 (see FIG. 3), 104 and 103 being preferably sewn, bonded, etc at there periphery. Plastic or the like loops 107 are affixed to somewhat central visibility element 200 preferably by threading a tail end of element 104 through loop element 107, then by folding over tail end of element 104 inward on itself and affixing the tail in this folded over on itself position (thus trapping element 107 for use as a pass-through loop). Strap ends of waist/torso belt element 80*b* are fed through pass-through loops 160 in plastic, metal or the like surcingle/suspender/belt buckle/clasp or the like mating side 105*a* of elements 105 and are affixed at the strap ends, glued, sewn, heat bonded or the like to the inner rung of plastic or the like adjuster (tri-glide loop or the like) elements 106 (commonly found on most back-packs) which have been feed onto straps or strap-like elements 80*b* so that they act to adjust the waist size of the waist/torso belt or the like. One end of strap or strap-like element 80*c* is affixed, glued, sewed, heat bonded or the like to element 100 preferably sewed, sandwiched between non-chafing fabric or the like element 102 and preferably reflective element 101. The other end of strap or strap-like element 80*c* is terminated with plastic, metal or the like surcingle/suspender/belt buckle/clasp or the like elements 105*b* of elements 105. One end of strap or strap-like element 110 positioned somewhat perpendicular to length of 80*c* is fed through loop 170 of elements 105 and is folded over itself and affixed, glued, sewed, heat bonded or the like in this folded over position to 80*c* so that 105*b* of 105 is trapped affixed to 80*c* so that 105 elements act as closure means for waist/torso belt element 80*b*, the assembly of 80*c* to 110 with closure elements 105 somewhat resembling upside down "T" shape. It should be understood that there are many options for providing closure means for waist/torso belt element 80*b* and there are many different ways to assemble these means to the harness, for example, element 105*b* could be affixed directly to element 80*c* eliminating intermediate element 110 if geometry was provided on 105 allowing for such (for example if a thin sewable tab was molded in 105*b* so that this element could be sewed through this thin area directly to 80*c* affixing it thereto).

Figure 2:
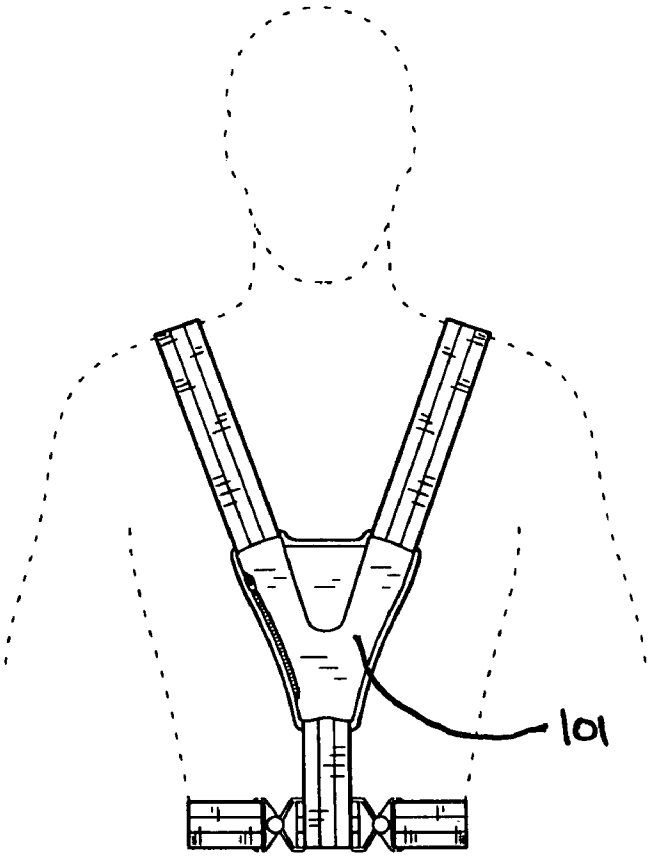
FIG. 2 shows a front view of the embodiment shown in FIG. 1

FIG. 2 shows a front view of the embodiment shown in FIG. 1

FIG. 3 shows a back view of the embodiment shown in FIG. 1

FIG. 4 shows a top view of the embodiment shown in FIG. 1 with adjusters 106 adjusted to fit a small person FIG. 5 shows a bottom view of the embodiment shown in FIG. 1 with adjusters 106 adjusted to fit a small person FIG. 6 shows a right view of the embodiment shown in FIG. 1 with adjusters 106 adjusted to fit a small person; the left side being a mirror image thereof FIG. 7 shows a back view close-up of the embodiment shown in Fig. (with shoulder straps shown cut short to fit on page). Stitching line 202 shows how preferable reflective sheet element 104 can be sewn to non-chafing fabric element 103 so that tail ends of 104 are folded over on itself and trapped between 104 and 103 to trap loop or the like elements 107 for use as pass-through loops for preferably bright reflective or the like strap or strap-like elements 80*a*.

FIG. 8 is a front view of the embodiment shown if FIG. 1 with minor geometric changes to pocket forming means. Window 120 in preferably reflective sheet material or the like 101*a* provides visual and tactile access to the contents of pocket forming means 100*a*. Window 120 is preferably affixed, glued heat bonded, sewed, etc. to 101*a* or this element just an opening for clear access to the contents of the pocket forming means. Window 120 can be clear vinyl sheet, mesh, stretch mesh, flexible fabric or the like.

FIG. 9 is a front view of the embodiment shown if FIG. 1 with minor geometric changes to pocket forming means. Preferably reflective sheet material or the like 101*b* with stretch area 111*b* is added with stretch or the like fabric or mesh or the like which provides expansion room for the contents held within pocket forming means 100*b*. Pocket forming means 100*b* is created similarly to 100 by preferably sewing, bonding, heat sealing around its periphery before stretch fabric, mesh or the like element 111*b* is affixed to 101*b*.

FIG. 10 is a front view of embodiment shown in FIG. I that shows a person using an electronic device that feeds a wire (or wires) through a pass-through hole 150. One or more pass-through holes can be provided in pocket forming means 100 to allow wires, antennas, straws, tubes or the like to pass from inside pocket forming means 100 to the outside.

FIG. 11 is a front view of embodiment shown in FIG. 1 that shows an electronic device in the pocket with an antenna or the like sticking through a pass-through hole 150.

FIG. 12 is a back view of an embodiment similar to FIG. 1 (straps shown cut short to fit on page) with integrated illumination elements 306, wire, circuit or the like elements 304, contact and/or controlling element 302 and power supply element 300. Illumination for central visibility element 200*d* can be provided in a number of ways. LED's or the like components (represented by elements 306) can be connected to a battery power supply (represented by element 300) and controlled by simple controlling circuit (represented by element 302) commonly found in LED bike light flashers to provide flashing illumination and/or more simple constant illumination can be provided as well by a switch which switches the controlling unit to change or eliminate the flashing rate.

FIG. 13 shows a front perspective view of a second preferred embodiment of the disclosed invention without pocket forming means 100. Instead central visibility or connection element 400 is used connected similarly to pocket forming means 100 shown in FIG. 1. Reflective and/or high visibility sheet material or the like material element 101*f* is preferably connected at its periphery to non-chafing fabric or the like element 102*f* preferably before a length of high visibility/reflective strap or strap-like elements 80*v* and 80*x* are inserted between 102*f* and 101*f* to insure these straps are sewn trapped in place between 101*f* and 102*f*. Please see the detailed description of FIG. 1 for understanding this FIG. 13. The only difference between these two figures is central visibility element 400 being switched out for pocket forming means 100 in FIG. 1.

FIG. 14 shows a front view of the second embodiment shown in FIG. 13 with adjusters 106 adjusted to fit a small person. It is important to note that the adjuster loops elements 107 could be fastened to the front or rear central panels depending on the desired adjustment direction (although the preferred configuration is pictured in this embodiment); FIG. 3 shows a preferred back view of the second embodiment shown in FIG. 13

FIG. 15 shows a top view of the embodiment shown in FIG. 13 with adjusters 106 adjusted to fit a small person.

FIG. 16 shows a bottom view of the embodiment shown in FIG. 13 with adjusters 106 adjusted to fit a small person.

FIG. 17 shows a right view of the embodiment shown in FIG. 13 with adjusters 106 adjusted to fit a small person.; the left side being a mirror image thereof FIG. 18 shows a front view close-up of the second embodiment shown in FIG. 17 (shoulder straps shown cut short to fit on page).

FIG. 19 shows a front perspective view of another embodiment of the novel "harness" without one or more added central visibility panel element(s). High visibility/reflective strap or strap-like elements 80*k* are sewn, bonded or the like to high visibility/reflective strap or strap-like element 80*m* affixed, sewn or the like in a "Y" shape (as denoted by 500). Please see the detailed description of FIG. 1 for understanding this FIG. 19. The only difference between these two figures is central 500 juncture being switched out for pocket forming means 100 in FIG. 1. Also it should be understood that for any of these embodiments central visibility element 200 can be changed out for a juncture similar to 500. Shoulder strap adjusting means can be provided by loops 107 affixed, sewn, bonded or the like to the tops of the "Y" straps and strap or strap-like elements 80*k* can be fed through plastic loops 107 as shown in FIG. 27.

Also FIG. 28 shows central visibility element 200 molded as one piece (700) with reflective/high visibility element 701.

FIG. 20 shows a front perspective view of another embodiment of the novel "harness" with a zipper closure across the top of a panel/utility pocket forming means. This embodiment is constructed identical to FIG. 1 embodiment except zipper 109*x* or other closure element or the like is assembled across the top of pocket forming means 100*x* affixed to stretch mesh or the like element 111*x* which has been affixed to high visibility sheet material element 101*x*, zipper closure element or the like 109*x* also affixed to 101*x* and non-chafing fabric or the like 102*x* to form closure means for pocket forming means 100*x*.

FIG. 21 shows a front perspective view of another embodiment of the novel "harness" with a snap, Velcro, button or other tab closure across at the top of the mouth of a panel/utility pocket forming means. This embodiment is constructed identical to FIG. 1 embodiment except closure element 109*y* or other closure element or the like is assembled at the top of pocket forming means 100*y* affixed to non-chafing fabric or the like element 102*y* which has been affixed to high visibility sheet material element 101*x*. Closure element or the like 109*y* is also removably affixed to 111*y* stretch mesh or the like fabric or other sheet material or the like to form reclosable closure means for pocket forming means 100*y*.

FIG. 22 shows a front perspective view of another embodiment of the novel "harness" with a more reverse triangle shaped front panel/utility pocket forming means. This embodiment is constructed identical to FIG. 8 embodiment except pocket forming means 100*r* is flipped 180 degrees and affixed in this orientation instead.

FIG. 23 shows a front perspective view of another embodiment of the novel "harness" with a simple "V" shaped front visibility/utility panel. This embodiment is constructed identical to FIG. 13 embodiment except for the shape of element 101*v* which is shown "V" shaped.

FIG. 24 shows a front perspective view of another embodiment of the novel "harness" (although less preferable) with a simple "V" shaped strap or strap like configuration. This embodiment eliminates vertical strap elements 80*x* and 80*y* as well as front central visibility element 100*s* connecting shoulder strap elements 80*t* directly to transition strap element 110*t*. Also the rear area shows central visibility element 200*t* connected directly to waist/torso belt or the like element 80*u*. Similarly central visibility element 200*t* can be eliminated altogether and replaced with a configuration like 800. A "V" shaped configuration as shown is less preferable than a "Y" shaped configuration because in this "V" shaped configuration it is more difficult to control the shoulder straps from slipping off the shoulders of the wearer.

FIG. 25 shows a front perspective view of another embodiment of the novel "harness" with a chest strap or the like added affixed to central visibility elements 100*q* and 200*q*. This embodiment is identical the embodiment shown in FIG. 13 except for the addition of chest strap elements 900 which are similar to waist/torso belt element 80*u*.

FIG. 26 shows a back view of an embodiment with a simple pass through shoulder strap configuration allowing both shoulder straps to be made of one continuous strap or strap like element. Strap or the like element 80*z* can be connected directly to plastic loop element 107 or via an intermediate element similar to connection element 200*z*. This is not a preferable configuration. One or two shoulder strap adjustment elements would have to be added to the front central visibility element to allow shoulder strap length adjustment.

FIG. 27 shows a back view of an embodiment with central visibility element changed out for "Y" strap configuration with affixed pass-through loops 106. A short length of strap or strap-like element 601 is folded over on itself and splayed at an angle of less than 90 degrees, then the folded over area is sewn in place to strap or strap-like element 80*e* and free ends are affixed, sewed, bonded or the like to pass-through loops 106. Also it should be noted that two short separate lengths of strap or strap-like elements can be splayed and sewed in this angled position instead of one folded over piece to get a similar result.

FIG. 28 shows a back view of an embodiment with plastic, metal or the like molded central visibility element/integrated pass-through slots. Reflector and/or transmissive lens element 701 affixed, bonded or integrally molded or the like to preferably plastic or the like central visibility element backing 702 provides added visibility. This embodiment can be constructed identical to FIG. 1, FIG. 13, etc. embodiments except central visibility element 700 is substituted for element 200 and/or element 400 and strap length addition 80*g* coming up from waist/torso belt strap element 80*b* is shown here threaded through slot 708 and sewn folded back on itself. Housed between elements 701 and 702 can be flashing LED elements and associated power supply (battery or the like) and electronics to provide illumination through reflector and/or transmissive (translucent, transparent or the like) lens element 701 as well as a user activated switch to allow the user to turn the light emitter on and off. Or, element 701 could just be a simple reflective type material like 3M Scotchlite.

Operation

To put the novel "harness" on the user would put his/her head through the shoulder straps as depicted in 80*a* and then fasten buckle elements 105*a* to 105*b* (see FIG. 8—wearer is depicted). Shoulder straps 80*a* are adjusted by sliding adjuster elements 106 which are provided on straps 80*a*. And waist/torso belt 80*b* is adjusted by sliding elements 106 which are similarly provided on straps 80*b*.

SUMMARY RAMIFICATIONS, AND SCOPE

Accordingly the reader will see that there are a number of advantages of the disclosed harness which can provide an effective warning indication of the presence of the wearer, is easily adjustable, intuitive to use, comfortable, fits a variety of body shapes and sizes easily, is simple to manufacture, doesn't tangle easily, is aesthetically pleasing, dissipates body heat, and allows the option of carrying personal items like keys, energy gel, chapstick, eye drops and the like.

Although the description above contains many specificities, these should not be construed as limiting the scope of the invention, but merely providing illustrations of some of the presently preferred embodiments of this invention.

Thus the scope of the invention should be determined by the appended claims and their legal equivalents, rather than by examples given.

We claim:

1. A harness, comprising:

a belt configured to be worn about a users waist;

a first shoulder strap having a first end and a second end;

a second shoulder strap having a first end and a second end;

a first panel formed from flexible material, the first panel having a front side and a back side, the first end of the first shoulder strap and the first end of the second shoulder strap being attached to the front side of the first panel;

a first vertical strap with a first end and a second end; the first end of the first vertical strap being attached to the front surface of the first panel; the second end of the first vertical strap being connected to the belt;

a second panel formed from a flexible material, the second panel having a front side and a back side, the second end of the first shoulder strap and the second end of the second shoulder strap each being attached to the second panel;

a second vertical strap with a first end and a second end; the first end of the second vertical strap being attached to the front surface of the second panel; the second end of the second vertical strap being connected to the belt;

a third panel formed from a flexible material; further, the third panel being attached to the front side of the first panel such that the first end of the first shoulder strap, the first end of the second shoulder strap and the first end of the first vertical strap are sandwiched between the first panel and the third panel, with at least one of the first panel or the third panel comprising a reflective surface;

a fourth panel formed from a flexible material, the fourth panel being attached to the front side of the second panel such that the first end of the second vertical strap is sandwiched between the second panel and the fourth panel, with at least one of the second or the fourth panel comprising a reflective surface; and the second end of the first vertical strap having a first fastener and a second fastener, whereby the second end of the first vertical strap is attached to the belt.

2. The harness of claim 1, further comprising a pocket, wherein the first panel comprises the back surface of the pocket and the third panel comprises the front surface of the pocket.

3. The harness of claim 2, wherein the pocket has a top end adjacent the first end of both the first shoulder strap and the second shoulder strap, a bottom end adjacent the first end of the first vertical strap, and a central region between the top and bottom ends, the bottom end of the pocket being narrower than at least one of the top end or the central region.

4. The harness of claim 1, wherein the first panel has a peripheral edge and the third panel has a peripheral edge, the first and third panels being attached at their peripheral edges to form a pouch with an opening thereto, the pouch defining exterior and interior surfaces.

5. The harness of claim 4, wherein the pouch has a closed top portion adjacent the first end of the first and second shoulder straps and a closed bottom portion adjacent the first end of the first vertical strap, the pouch further having a first opening with a fastener to enclose the first opening, and a second opening adjacent the top end of the pouch, the second opening being relatively smaller than the first opening.

6. The harness of claim 1, wherein the first fastener comprises a clasp and the second fastener comprises a clasp; the first fastener being connected to the first end of the belt and the second fastener being connected to the second end of the belt; wherein the second end of the first vertical strap is interposed between the first and second fasteners.

7. The harness of claim 1, wherein the fourth panel includes a region formed from reflective material and further comprises a first loop retaining the first shoulder strap and a second loop retaining the second shoulder strap.

8. A harness, comprising:

a belt having a first end and a second end; the belt being configured to be worn about a user's waist;

a first shoulder strap having a first end and a second end;

a second shoulder strap having a first end and a second end;

a first panel comprised of flexible material, the first panel having a front side, a back side and a peripheral edge; the first end of the first shoulder strap and the first end of the second shoulder strap being attached to the front side of the first panel;

a first vertical strap with a first end and a second end, the first end being attached to the front surface of the first panel; the second end being connected to the belt;

a second panel comprised of flexible material, the second panel having a front side, a back side and a peripheral edge;

a first loop and a second loop each attached to the front side of the second panel, the first loop being configured to hold the first shoulder strap and the second loop being configured to hold the second shoulder strap;

a second vertical strap with a first end and a second end; the first end being attached to the front surface of the second panel; the second end being connected to the belt;

a third panel comprised of flexible material having a front side, a back side and a peripheral edge; the third and first panels further being attached substantially at their peripheral edges such that the first end of the first shoulder strap, the first end of the second shoulder strap, and the first end of the first vertical strap are sandwiched between the first and third panels; at least one of the first or the third panels comprising a reflective surface;

a fourth panel comprised of flexible material having a front side, a back side and a peripheral edge; the fourth and second panels further being attached substantially at their peripheral edges such that the first end of the second vertical strap is sandwiched between the second and fourth panels; at least one of the second or the fourth panel comprising a reflective surface; and a first fastener and a second fastener each adjacent the second end of the first vertical strap, the first fastener being connected to the first end of the belt and the second fastener being connected to the second end of the belt.

9. The harness of claim 8, wherein the second end of the first vertical strap is interposed between the first and second fasteners, and further the first fastener comprises a first clasp and the second fastener comprises a second clasp.

10. The harness of claim 8, further comprising a pocket formed on the first panel wherein the pocket has an opening, a front surface formed by the third panel, and a back surface formed by the first panel.

11. The harness of claim 10, wherein the pocket has a top end adjacent the first end of the first and second shoulder straps, a bottom end adjacent the first end of the first vertical strap, and a central region between the top and bottom ends, the bottom end of the pocket being narrower than at least one of the top end or the central region.

12. The harness of claim 10, wherein the pocket has a closed top portion adjacent the first end of the first and second shoulder straps and a closed bottom portion adjacent the first end of the first vertical strap, the pocket further having a first opening with a fastener to enclose the first opening, and a second opening adjacent the top end of the pocket, the second opening being relatively smaller than the first opening.

13. A harness, comprising:

a belt having a first end and a second end; the belt configured to be worn about a user's waist;

a first shoulder strap having a first end and a second end;

a second shoulder strap having a first end and a second end;

a first panel comprised of flexible material, the first panel having a front side and a back side; the first end of the first shoulder strap and the first end of the second shoulder strap being attached to the front side of the first panel; the first panel further being connected to the belt;

a second panel comprised of flexible material, the second panel having a front side and a back side; the second end of the first shoulder strap and the second end of the second shoulder strap being connected to the front side of the second panel; the second panel further being attached to the belt;

a third panel comprised of flexible material, the third panel being attached to the front side of the first panel such that the first end of the first shoulder strap and the first end of the second shoulder strap is sandwiched between the first and third panels; at least one of the first or the third panel comprising a reflective surface;

a fourth panel comprised of flexible material, the fourth panel is attached to the front side of the second panel; at least one of the second or the fourth panel comprising a reflective surface;

a first fastener connected to the first end of the belt and a second fastener connected to the second end of the belt; and a third fastener and a fourth fastener each connected to the first panel or the second panel, wherein the first fastener is adapted for releasable attachment to the third fastener and the second fastener is adapted for releasable attachment to the fourth fastener, the third and fourth fasteners being connected in opposition to one another.

14. The harness of claim 13, further comprising a pocket formed on the first panel wherein the pocket has a front surface and a back surface; the first panel comprises the back surface of the pocket and the third panel comprises the front surface of the pocket.

15. The harness of claim 14, wherein the pocket has a top end adjacent the first end of both the first and second shoulder straps, a bottom end adjacent the third and fourth fasteners, and a central region between the top and bottom ends, the bottom end of the pocket being narrower than at least one of the top end or the central region.

16. The harness of claim 13, wherein the first panel has a peripheral edge and the third panel has a peripheral edge, the first and third panels being attached at their peripheral edges to form a pouch with an opening thereto, the pouch defining exterior and interior surfaces.

17. The harness of claim 16, wherein the pouch has a closed top portion adjacent the first end of the first and second shoulder straps and a closed bottom portion adjacent the third and fourth fasteners, the pouch further having a first opening with a fastener to enclose the first opening, and a second opening adjacent the top end of the pouch, the second opening being relatively smaller than the first opening.

18. The harness of claim 13, wherein the fourth panel includes a region of reflective material and is configured such that it comprises a first Loop and a second loop; the first and second loops joined, respectively, to a third loop and a fourth loop; the third loop being configured to hold the first shoulder strap and the fourth loop being configured to hold the second shoulder strap.

19. The harness of claim 13, wherein the second panel comprises an extension connected to the belt.

20. The harness of claim 19, further comprising an extension interposed between the third and fourth fasteners.

* * * * *